US006407722B1

(12) United States Patent
Bogner et al.

(10) Patent No.: US 6,407,722 B1
(45) Date of Patent: Jun. 18, 2002

(54) CHOKE COUPLED COAXIAL CONNECTOR

(75) Inventors: Bruce Fredric Bogner, Margate, NJ (US); Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/803,273

(22) Filed: Mar. 9, 2001

(51) Int. Cl.[7] ..... H01Q 1/50

(52) U.S. Cl. ..... 343/906; 343/905; 174/138 A; 439/916

(58) Field of Search ..... 343/906, 905, 343/790, 791, 792; 174/138 A, 154; 439/916; H01Q 1/50

(56) References Cited

U.S. PATENT DOCUMENTS 3,939,446 A * 2/1976 Kozul et al. ..... 333/98 R
4,748,450 A * 5/1988 Hines et al. ..... 343/820
5,169,324 A * 12/1992 Lemke et al. ..... 439/101

OTHER PUBLICATIONS

"Principles of Radar" by Reintjes and Coate, Technology Press of Massachusetts of Technology, 1952, pp. 810–811.

* cited by examiner

*Primary Examiner*—Hoanganh Le
(74) *Attorney, Agent, or Firm*—Duane Morris LLP

(57) ABSTRACT

A choke coupled coaxial connector includes a hybrid transmission line center conductor including an open-circuited transmission line having one-quarter electrical wavelength, which presents an effective short-circuit at a gap in the center conductor structure. The choke coupled connector also includes an open-circuited hybrid transmission line outer conductor also one quarter-wavelength long, which presents an effective short-circuit in a gap in the outer conductor structure. According to an aspect of the invention, certain interior surfaces of the connector are coated with dielectric to prevent galvanic contact and for reduced mating forces. According to another aspect of the invention, the male and female portions of the choke coupled coaxial connector are prevented from rotating. In a particularly advantageous embodiment, an array of choke coupled coaxial connectors.

11 Claims, 14 Drawing Sheets

FEMALE 14

ELLIPTICAL CROSS-SECTION

RECTANGULAR CROSS-SECTION

ALTERNATE CROSS-SECTIONS

CHOKE COUPLED COAXIAL CONNECTOR

FIELD OF THE INVENTION

This invention relates to coaxial connectors, and more particularly to coaxial connectors exhibiting relatively low mating and de-mating force requirements and transmission stability under severe environmental conditions.

BACKGROUND OF THE INVENTION

Modern antenna design makes increasing use of broadside array antennas, in which a plurality of elemental antennas are arrayed to define a radiating aperture larger than that of a single elemental antenna, with the principal direction of radiation generally orthogonal to the plane of the array. Such array antennas have advantages by comparison with other types of antennas, as for example by virtue of being physically planar and broadside to the direction of radiation. When fitted with controllable phasing elements, the antenna beam or beams of such an array can be scanned without the need for motion of the array antenna as a whole. An array antenna is normally associated with a "beamformer," which specifies or controls the division of the signals to be transmitted among the antenna elements of the array, andor which specifies or controls the combination of signals received by the elements of the array to form the received signal. Such a beamformer has a finite loss, which directly contributes toward the noise figure of a receiver in a reception mode, and which attenuates the signal to be transmitted in a transmission mode.

The losses attributable to a beamformer can be ameliorated by associating each element or subarray of elements of an array antenna with an amplifier. In a reception mode, the signals received by each antenna element or subarray of antenna elements is amplified by a low-noise amplifier before being attenuated by the beamformer, so that the noise figure of the antenna-plus-receiver-plus beamformer arrangement is superior to that of an antenna-plus-beamformer-plus-low-noise amplifier. In a transmission mode of operation, associating each antenna element or subarray of antenna elements with a power amplifier allows the full power of each amplifier to be broadcast, rather than suffering the losses of the beamformer.

When array antennas are used, certain practical problems arise which relate to the making of connections. In two-dimensional arrays the beamforming is often configured by row and column combiners that are oriented normal to each other and normal to the aperture plane. The spacing between connectors in each row and the spacing between rows is generally equivalent to the spacing between the radiators in the array, which is inversely proportional to the operating frequency. Therefore, for high-frequency applications with small connector-to-connector spacing along the combiner boards, special connectors are needed to fit within the space constraints, because it is not possible to physically access individual connections, and the making of blind connections requires tight tolerances. It is in this row/column combining that the invention has been found to be most advantageous. It has been found that the metal spring contacts of conventional coaxial connectors tend to lose spring with time, especially in the presence of multiple cycles of mating and de-mating. Also, corrosion or equivalent degradation occurs, even in a space environment, which tends to affect the coupling. Variations in the magnitude andor phase of the coupling of connectors in the feed paths of elements of antenna arrays has been found to be a significant problem, because testing of such antennas and preparation for launch into space in the case of satellite antennas involves repeated mating and de-mating cycles. The mating involves making multiple simultaneous blind connections in the presence of axial and radial misalignments attributable to unavoidable mechanical tolerances. If the connectors themselves change coupling during the course of the various tests, it is difficult to separate problems in the antenna array and the associated amplifiers and phase shifters from problems in the connectors.

Improved connectors are desired.

SUMMARY OF THE INVENTION

A coaxial choke connector according to an aspect of the invention is for use with a coaxial transmission line having a characteristic impedance defined by an exterior first diameter of an inner conductor and an interior second diameter of an outer conductor, or at least a transmission line having a characteristic impedance characterizable by an exterior diameter of an inner conductor and an interior diameter of an outer conductor if it were coaxial. The coaxial choke connector includes a male portion and a female portion. The male portion of the coaxial choke connector includes an electrically conductive center choke conductor defining a proximal end and a distal end, and an electrically conductive outer choke conductor also defining a proximal end and a distal end. The proximal end of the center choke conductor is coupled to the inner conductor of the coaxial transmission line, and the proximal end of the outer choke conductor is coupled to the outer conductor of the coaxial transmission line. The center choke conductor of the male portion of the coaxial choke connector has a first length, a circular cross-section centered on a longitudinal axis, and a third diameter less than the first diameter. The outer choke conductor of the male portion of the coaxial choke connector has an inner fourth diameter which defines a circular cross-section centered on the axis and which is larger than the second diameter. The center choke conductor of the male portion has a layer of solid dielectric on the outer surface thereof, so that the center choke conductor with the layer of solid dielectric thereon has a fifth diameter smaller than the first diameter.

The female portion of the coaxial choke connector includes an electrically conductive center choke conductor and an electrically conductive outer choke conductor. The inner choke conductor of the female portion of the coaxial choke connector defines a closed-end axial bore with respect to the longitudinal axis, and the axial bore has a second length and a sixth diameter larger than the fifth diameter. In a preferred embodiment, the center choke conductor of the female portion has an outer diameter equal to the first diameter. The outer choke conductor of the female portion has an inner diameter equal to the second diameter, and an outer diameter coated with a solid dielectric material, so that the overall outer diameter of the outer choke conductor of the female portion, together with the solid dielectric material, has a seventh diameter, smaller than the fourth diameter. The coaxial choke connector also includes a stop arrangement associated with the male and female portions of the coaxial choke connector, for allowing the male and female portions to mate, but without allowing galvanic contact between (a) the distal end of the center choke conductor of the male portion and the closed end of the axial bore of the center choke conductor of the female portion and (b) the outer choke conductors of the male and female portions of the coaxial choke connector.

In a particularly advantageous embodiment of the coaxial choke connector, at least one of (a) the distal end of the center choke conductor of the male portion is tapered to a diameter smaller than the third diameter and (b) the distal end of the center choke conductor of the female portion is tapered to a thickness less than that existing over a portion of the center choke conductor remote from said distal end. In yet a further embodiment, the distal end of the center choke conductor of the male portion extends beyond the plane of the distal end of the outer choke conductor of the male portion, for enhancing the ability to mate the male and female portions.

The coaxial choke connector may be used with any unbalanced transmission line having a characteristic impedance near, or preferably equal to, that of the coaxial choke connector. Such a transmission line might be stripline or microstrip.

DESCRIPTION OF THE INVENTION

Figure 1:
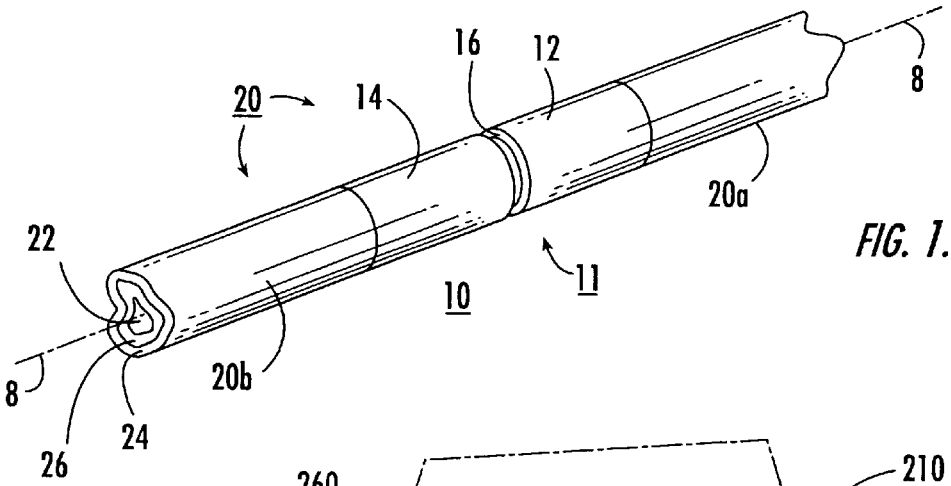
FIG. 1 is a simplified perspective or isometric view of a coaxial cable with a mated connector arrangement at a location along the length of the cable.

In FIG. 1, a coaxial transmission line arrangement is designated generally as 10, centered about a local axis 8. Arrangement 10 includes a coaxial transmission line 20 having two portions 20*a* and 20*b*, connected together by a conjoined connector 11 including a male portion 12 and a female portion 14. As illustrated in FIG. 1, a gap 16 is visible in the outer portion of the conjoined connector 11. The coaxial transmission line 20 includes the conventional center conductor 22, outer conductor 24, and dielectric medium 26. The dielectric medium may be air or another gas, or it may be a solid material such as polyethylene, Teflon, or some other material.

Those skilled in the art know that transmission lines are a form of electrical power coupling arrangement in which the impedance or "characteristic" impedance is maintained substantially constant along the length, or in which the impedance at each location along the transmission line is controlled relative to that at other locations. The concepts of characteristic impedance of a coaxial transmission line are well known in the art, and may be found in various science and electronics dictionaries. In general, the characteristic impedance of a transmission line is related to the ratio of the outer diameter of an inner conductor to the inner diameter of an outer conductor, taking into account the dielectric medium separating the two.

Those skilled in the art also know that the term "connected," "between," and like terms when used in an electrical coupling context does not necessarily have a meaning which relates to physical placement, but rather relate to the electrical result of the physical arrangement.

In the arrangement of FIG. 1, electromagnetic energy propagating in either direction through coaxial transmission line 20 passes through the conjoined connectors 11 with relatively low attenuation, so long as the male and female connector portions 12 and 14, respectively, are mated.

Figure 2:
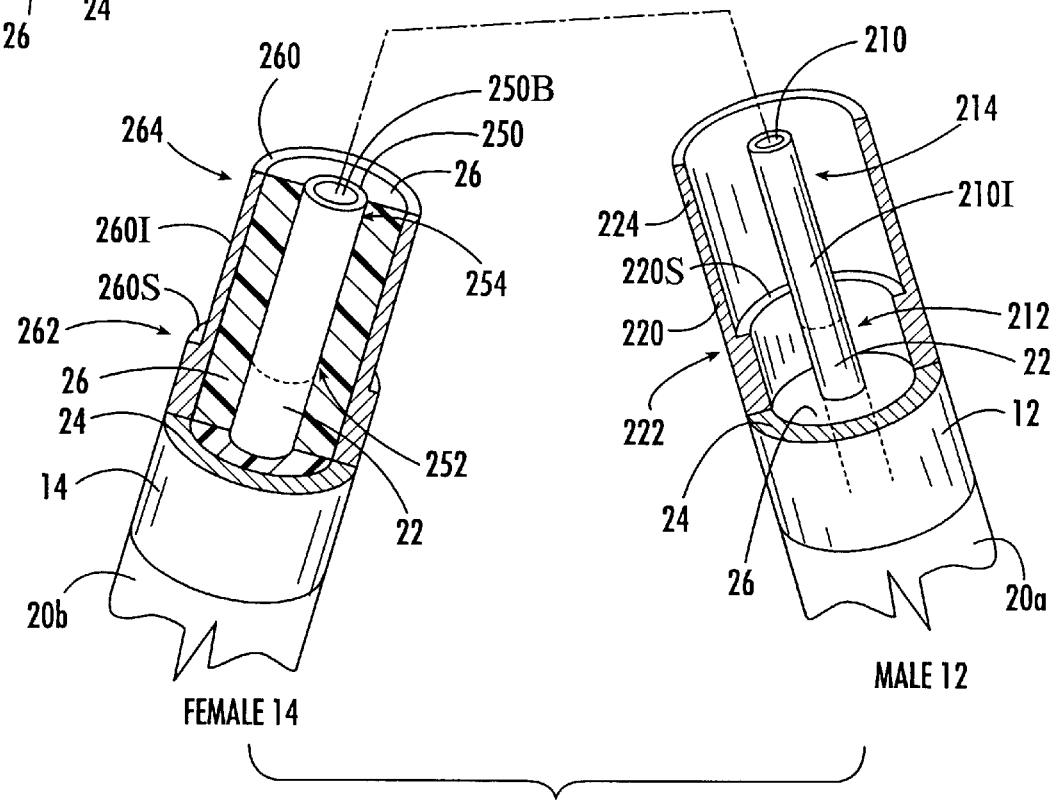
FIG. 2 is a simplified perspective or isometric view, of the two halves of the mated connector of FIG. 1, partially cut away to reveal interior details.

In FIG. 2, the male portion 12 of connector 11 includes an electrically conductive center choke conductor 210 defining a proximal end 212 and a distal end 214. Male portion 12 of conductor 11 also includes an electrically conductive outer choke conductor 220 defining a proximal end 222 and a distal end 224. The proximal end 212 of center choke conductor 210 is physically coupled to the inner conductor 22 of that portion of the coaxial transmission line 20 coupled to male connector portion 12. The proximal end 222 of the outer choke conductor 220 is physically coupled to the outer conductor 24 of the coaxial transmission line portion 20*a* at or near a step 220S. The center choke conductor 210 of the male portion 12 of the coaxial choke connector 11 has a circular cross-section centered on longitudinal axis 8. The outer choke conductor 220 defines a circular cross-section centered on axis 8, and also defines a step in thickness near or at its proximal end, such that the interior diameter of the outer choke conductor 220 is greater than the interior diameter of the outer conductor 24 of coaxial cable portion 20*a*. In the arrangement of FIG. 2, the distal end 214 of the center choke conductor 210 of the male portion 12 of the coaxial choke connector 11 lies in substantially the same plane as the plane of the distal end 224 of the outer choke conductor 220 of the male portion 12. The center choke conductor 210 has a layer 210I of solid dielectric or electrical insulation on its outer surface. The dielectric material 210I surrounding the center choke conductor 210 may be a low-loss material such as Teflon.

Also in FIG. 2, the female portion 14 of connector 11 includes an electrically conductive center choke conductor 250 defining a proximal end 252 and a distal end 254. Center choke conductor 250 of female portion 14 defines a closed-end axial bore 250B concentric with axis 8, which bore is dimensioned to accept center choke conductor 210 and its dielectric layer 210I of the male portion 12 of connector 11. Female portion 14 of connector 11 also includes an electrically conductive outer choke conductor 260 defining a proximal end 262 and a distal end 264. The outer diameter of outer choke conductor 260 is smaller than the outer diameter of outer conductor 24 of portion 20*b* of coaxial transmission line 20*b*, and joins outer conductor 24 of coaxial transmission line 20*b* at a step 260S. The outer surface of outer choke conductor 260 is coated with a layer 260I of electrical insulating material. In general, the inner choke conductor 210 of male connector portion 12, together with its insulating layer 210I, fits within the bore 250*b* of the center choke conductor of female portion 14 of connector 11 when the two portions are mated, and the outer choke conductor 260 of female connector portion 14, together with its insulating layer 260I, fit within outer choke conductor 220 of male connector portion 12. In FIG. 2, the distal ends of the dielectric 26, the center choke conductor 250, and the outer choke conductor 260 lie in substantially the same plane.

Figure 10:
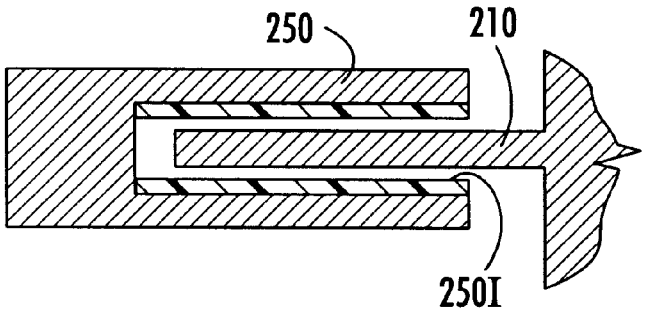
FIG. 10 is a simplified cross-sectional view of an alternative insulation arrangement for the center choke conductors of the arrangement of FIGS. 2*a* and 2*b;*

FIG. 10 illustrates an alternative arrangement of the female center choke conductor 250 and male center choke conductor 210. In FIG. 10, instead of a layer of insulation 210I lying on the outer surface of male center choke conductor 210 as in FIG. 3, a layer 250I of insulation is applied to the inner surface of bore 250B of the female center choke conductor. Either arrangement serves to isolate the two center choke conductors from each other. Naturally, both layers could be used if desired.

Figure 3:
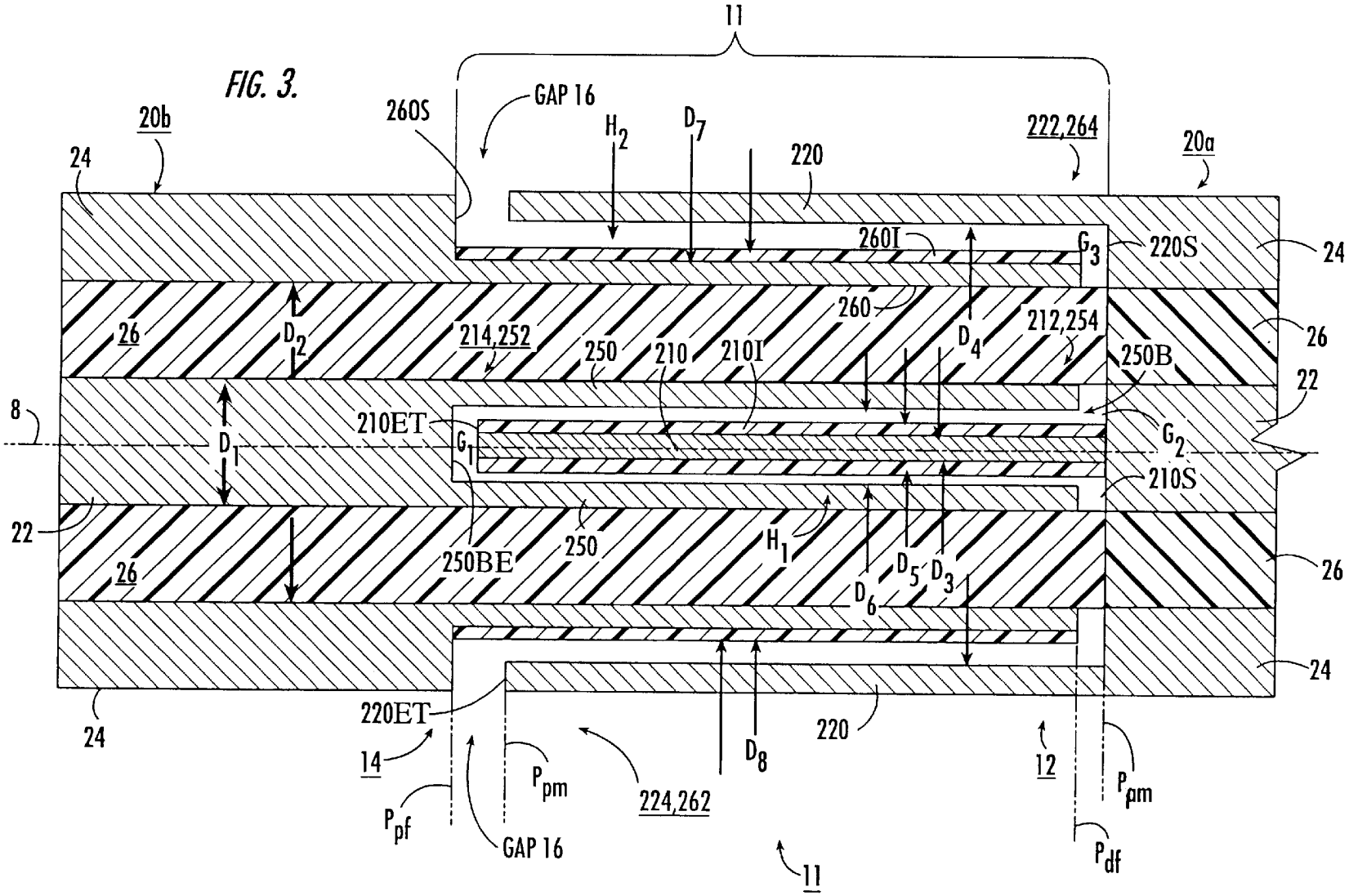
FIG. 3 is a simplified cross-sectional view of a slightly modified version of the coaxial choke connector of FIG. 1 with the male and female portions mated.

It should be noted that the exact location at which the male and female connector portions 12 and 14, respectively, of FIG. 3 make the transition into the associated coaxial transmission lines 20*a* and 20*b*, respectively, is not well defined. This lack of definition arises because, if the dielectric materials which are used in the connector and the transmission lines are of the same type, the center conductors 22 of the coaxial transmission lines 20*a*, 20*b* and the center choke conductors 210, 250 of the male and female portions 12 and 14, respectively, of the connector 11 have the same outer diameter. Consequently, unless there is some marking or physical manifestation at the juncture of the two conductors, its precise location may be difficult to determine. Similarly, the outer diameter of the outer choke conductor 220 of the male portion 12 of connector 11 can be the same as the outer diameter of the outer conductor 24 of the coaxial transmission lines 20*a*, and the inner diameter of outer choke conductor 260 of female connector portion 14, in a preferred embodiment of the invention, has the same inner diameter as that of the corresponding outer conductor 24 of transmission line 20*b*, so there may be no identifiable juncture unless the locations are marked. Thus, near the distal ends of the male and female connectors, it may be difficult to determine whether a structural piece is part of the connector or of the transmission line. A reason for this lack of definition lies in the need for coaxial transmission line structures to maintain relatively constant dimensions in order to tend to maintain relatively constant impedance from point to point along the transmission line.

FIG. 3 is a simplified cross-sectional view of a slightly modified version of the coaxial choke connector 11 of FIG. 1 with the male and female portions 12, 14, respectively, mated. The only difference between the connector 11 of FIGS. 2 and 3 lies in the length of the center choke conductor 210 of the male portion 12 of the coaxial choke connector 11. In FIG. 3, the female portion 14 of the conjoined connector portions is on the left, and the male portion 12 is on the right. The right-most end or proximal end 212, 222 of the male connector may be viewed as being at a plane $P_{pm}$, and the left-most or proximal end 252, 262 of the female portion 14 of the connector 11 may be viewed as being coincident with a plane $P_{pf}$. The distal end 214, 224 of the male portion 14 may be viewed as being substantially coincident with a plane $P_{dm}$, although as mentioned the center choke conductor 210 may extend a bit beyond this plane. The distal end of the female portion 14 may be viewed as being coincident with a plane $P_{df}$. Since the planes $P_{dm}$ and $P_{df}$ are within the range established by planes $P_{pf}$ and $P_{pm}$, one possible measure of the "location" of the conjoined coaxial connector 11 may be between planes $P_{pf}$ and $P_{pm}$.

As illustrated in FIG. 3, the center choke conductor 210 of male portion 12 is connected at its right-most or proximal end by way of a step change in diameter 210S to the center conductor 22 of portion 20*a* of coaxial transmission line 20. The diameter of center conductor 22 of coaxial transmission line 20 is designated $D_1$, and the diameter of the inner surface of the outer conductor 24 is designated $D_2$. Center choke conductor 210 extends from plane $P_{pm}$ to about plane $P_{dm}$ with a constant diameter $D_3$, except that its distal end 214 may have an end tapered as indicated by 210ET, to aid in mating the connector halves.

Center choke conductor 250 of female portion 14 of connector 11 is connected and supported at its proximal end to center conductor 22 of portion 20*b* of coaxial transmission line 20. This physical connection coincides with plane $P_{pf}$. Center choke conductor 250 extends distally from its connection to center conductor 22 to plane $P_{df}$, and thus the distal end 254 of the center choke conductor 250 of female portion 14 does not reach as far as the electrically conductive portion of center conductor 22 of portion 20*a* of coaxial transmission line 20 at step 210S. Center choke conductor 250 of female portion 14 of FIG. 3 defines a bore 250B which has a diameter $D_6$ greater than the diameter $D_3$ of the center choke conductor 210 of the male portion 12. Bore 250B has a closed end defined by a wall 250BE. The depth of bore 250B extends from plane $P_{df}$ to plane $P_{pf}$. When fully mated, the male and female coaxial connector half portions 12 and 14, respectively, are located so that physical contact does not occur between the distal end 214 of center coaxial conductor 210 and the end wall 250BE of bore 250B.

Center choke conductor 210 of male connector portion 12 of FIG. 3 has its outer surface covered by an electrically insulating material 210I, to avoid the possibility of electrical contact between the choke center conductor 210 of male portion 12 and the interior surface of bore 250B of choke center conductor 250 of female portion 14. The material is desirably Teflon to aid in reducing friction which may occur between the two center choke conductors during mating, and to prevent inadvertent direct electrical (galvanic) contact between them during operation, as might occur during flexing of the conjoined connector 11. With the presence of insulating layer 210I, the interior bore diameter $D_6$ must be greater than the diameter $D_5$ of the center choke conductor 210 with its insulating layer 210I.

Outer choke conductor 220 of male portion 12 of connector 11 has an inner diameter $D_4$ greater than diameter $D_2$ of the outer conductor 24 of either portion 22*a* or 22*b* of coaxial transmission line 22. Outer choke conductor 220 of male portion 12 is physically connected to and supported by outer conductor 24 of coaxial transmission line portion 20*a* at a step in dimension 220S. The length of outer choke conductor 220 of male portion 12 extends distally from plane $P_{pm}$ to plane $P_{dm}$. Outer choke conductor 260 of female portion 14 of coaxial choke connector 11 has an outer diameter $D_7$ which is smaller than inner diameter $D_4$ of the outer choke conductor 220 of the male portion 12 of connector 11. Outer choke conductor 260 of female portion 14 of coaxial choke connector 11 is connected to outer conductor 24 of portion 20*b* of coaxial transmission line 20 at a step in dimension 260S. The distal end 224 of outer choke conductor 220 of male portion 12 of connector 11 may be tapered in thickness, as illustrated by 220ET, to promote self-centering of the connector halves during mating.

It should be understood that the outer diameter of the outer conductor 24 of portions 20*a* and 20*b* of coaxial transmission line 20 of FIG. 3 are not particularly important, except as they relate to the strength of the outer conductor, as the electrical fields are constrained within the coaxial transmission line. Consequently, the outer diameter of the outer conductor 24 of portion 20*b* of coaxial transmission line 20 can, in principle, be of any diameter. This being so, there is no absolute requirement that there be a step of a given dimension, or any step dimension at all, corresponding to step 260S between the outer choke conductor 260 of female portion 14 and the outer diameter of outer conductor 24 of portion 20*b* of coaxial transmission line 20.

The outer surface of outer choke conductor 260 of female portion 14 of coaxial transmission line 20 of FIG. 3 is coated or covered with a layer of dielectric insulating material, which may be Teflon. The inner diameter $D_4$ of the outer choke conductor 220 of male portion 12 must then be at least no less in diameter than diameter $D_8$, and should be a bit larger than $D_8$ to prevent the possibility of an interference fit when the male and female connector halves 12, 14 are mated.

As described, the structure of FIG. 3 allows the male and female portions 12, 14 of the connector 11 to be mated. It is desirable to have a positive stop which defines the maximum desired penetration of the male portion into the female portion. In the arrangement of FIG. 3, the stop is provided by the juxtaposition of the distal end of the dielectric material 26 of the female connector portion 14 at plane $P_{pm}$ with the dielectric material 26 of the male portion 12 or of the coaxial transmission line portion 20*a*, depending upon the view taken as to where the connector proper ends. The stopped positions of the mated male and female portions 12, 14 of connector 11 are such that a gap G1 occurs or exists between the distal end 214 of center choke conductor 210 and end wall 250BE, a gap G2 occurs or exists between the distal end 254 of choke center conductor 250 and step 210S, a gap G3 occurs or exists between distal end 264 of outer choke conductor 260 of female portion 14 and step 220S, and a gap 16 occurs or exists between the distal end 224 of outer choke conductor 220 and step 260S or plane $P_{pf}$. Thus, the center conductor 22 of coaxial transmission line portions 20*a* and 20*b* are coupled together across gap G2 by an impedance established by an open-circuited hybrid transmission line including center choke conductors 210 and 250. This hybrid transmission line is designated H1.

As known to those skilled in the art, the impedance at the gap G2 will be minimized when the length of the open-circuited hybrid transmission line H1 is one quarter wavelength, or odd multiples of one quarter wavelength. Thus, the open-circuited end of the hybrid transmission line H1, including center choke conductors 210, 250 "reflects" to an effective short-circuit at gap G2 at frequencies such that the electrical length of the hybrid transmission line H1 is about one quarter wavelength. The frequency at which this occurs is designated F1. Similarly, while there is no galvanic connection between the coaxial transmission line portions 20*a* and 20*b*, the outer conductors are coupled together at gap G3 by a second hybrid transmission line H2 including a "center" conductor defined by the outer surface of outer choke conductor 260 and an "outer" conductor defined by the inner surface of outer choke conductor 220, together with a radial gap transmission path or line at gap 16. Both ends of hybrid transmission line H2 are open-circuited, so the impedance at each gap G3 and 16 may be minimized or made nearly a short-circuit by making the electrical length of transmission line H2 equal to one-quarter wavelength at F1. When the electrical lengths of both H1 and H2 are about one-quarter wavelength, gaps G2 and G3 appear to be short-circuits or almost short-circuits, as a result of which at frequency F1, the center conductors 22 of coaxial transmission line portions 20*a* and 20*b* appear to be electrically connected by the conductive outer surface of center choke conductor 250 and the low impedance of gap G2. Similarly, at frequency F1, the outer conductors 24 of coaxial transmission line portions 20*a* and 20*b* appear to be connected together by the electrically conductive interior surface of outer choke conductor 260 in series with the low impedance of gap G3.

Thus, when the male and female connector halves 12, 14 are fully mated as illustrated in FIG. 3, there is in principle no galvanic connection between the male and female connector portions. Any forces which may be applied to the mated connectors can move the two portions relative to each other somewhat, but cannot make galvanic connection. Electrical coupling between the two portions is provided by choke coupling, generally similar to that used in rotary coaxial joints, and described, for example, at pages 810–811 of the text "Principles of Radar" by Reintjes and Coate, Technology Press of Massachusetts Institute of Technology, 1952. In the mated condition, the center choke conductors 210 and 250 together form an open-circuited hybrid transmission line including a "sub" or small coaxial transmission line in which the center conductor is center choke conductor 210, and the outer conductor is the center choke conductor 250, serially coupled with a radial transmission line defined by gap G2. This small or sub coaxial transmission line is fed in the region of gap G2, and is open-circuited by gap G1. Similarly, in the mated condition, the outer choke conductors define or form an open-circuited hybrid transmission line. The open circuits reflect a low impedance to the end gaps at frequencies such that the lengths of the hybrid transmission lines are one-quarter wave in electrical length. Of course, they could have lengths of 2N+1 (odd numbers) of quarter-wavelengths, but this will not generally be desirable, as the frequency range where there is an effective short-circuit across the gap is reduced as the length of the choke section is increased.

Figure 4:
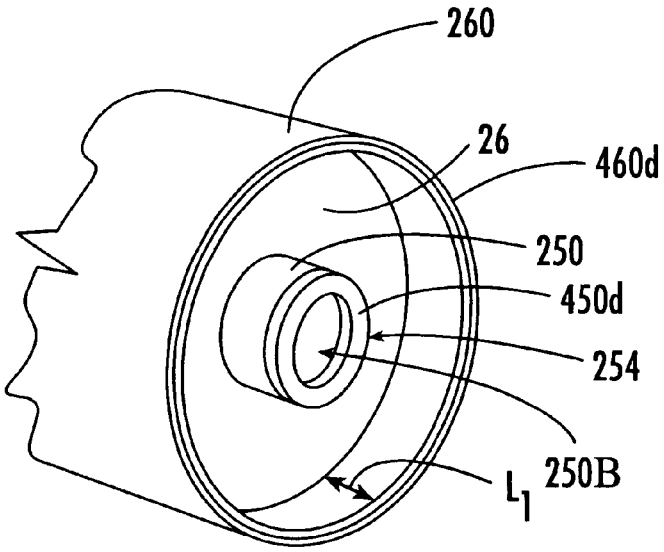
FIG. 4 is a simplified diagram illustrating a portion of the end of a female portion of the connector of FIGS. 1 and 2, modified to include a dielectric stop.

Instead of using the dielectric material 26 at plane $P_{pm}$ as the stop for the mating of the connector halves 12, 14 in the arrangement of FIG. 3, the dielectric material of the female portion 14 of connector 11 may be recessed by a distance $L_1$ "below" the plane including the distal ends 254, 264 of the center choke conductor 250 and the outer choke conductor 260 as illustrated in FIG. 4, so that it does not act as a stop. Instead, the stop function may be provided by an insulative ring 450*d* placed over the distal end of center choke conductor 250, andor a further insulative ring 460*d* placed over the distal end of outer choke conductor 260. Other mountings and locations for such dielectric stops are possible.

Figure 5:
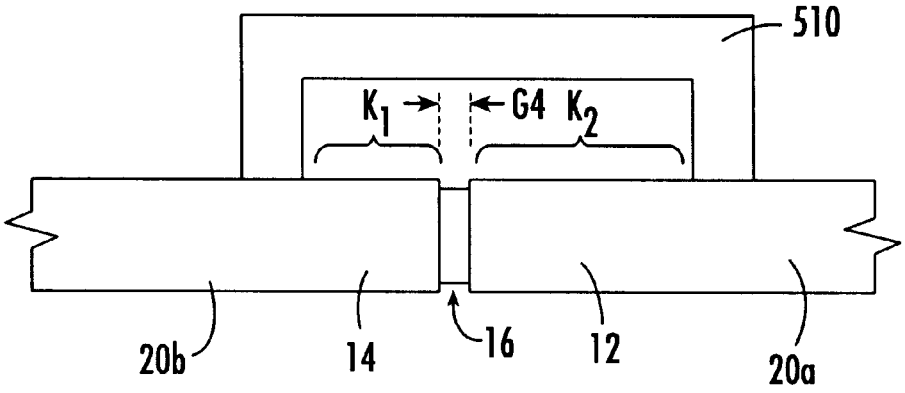
FIG. 5 is a simplified overall view of the connector of FIGS. 1 and 2 in the mated state, together with one form of a structure for holding the mated connectors against withdrawal and rotation.

According to an aspect of the invention, the two halves of a coaxial choke connector are held together in a manner which avoids substantial relative rotation. In FIG. 5, connector 11 of FIG. 1 is associated with a physical connection mechanism 510. This physical connection mechanism bridges gap 16, and is firmly fastened on the one side to the connector portion 12 or to coaxial transmission line portion 20*a*, or both, and on the other side is firmly fastened to connector portion 14, coaxial transmission line portion 20*b*, or to both. The fastening may be by clamping, fusion such as soldering or welding, or by bolting if sufficient purchase (grip) can be achieved. It might be expected that, since the operation of the choke connector as described above depends upon the hybrid transmission lines being open-circuited at the ends opposite the ends at which coupling through the gaps is desired, that the presence of the physical structure 510 of FIG. 5 would adversely affect performance, especially if the structure is metallic and therefore electrically conductive. It has been found that if the connections of the physical coupling structure 510 to the transmission lines 20*a*, 20*b* or the connectors 12, 14 are spaced by more than about ten gap widths from the gap, there is little effect on the performance of the choke-coupled connector 11. Thus, in the arrangement of FIG. 5, if the longitudinal length of gap 16 is G4, it is sufficient if the structure 510 is connected to the transmission-line structure at distances K1, K2 from gap 16 of greater than 10G4.

Another advantageous use of choke-coupled connectors according to the invention lies in providing connections between microstrip or stripline transmission lines and coaxial transmission lines. FIG. 5 illustrates how a microstrip transmission line may be coupled to the distal end of either a male or female connector. In FIG. 5, According to another aspect of the invention, a plurality of connectors such as those of FIGS. 2 or 3 are ganged or arrayed for simultaneous engagement and disengagement. Those skilled in the art realize that two halves of each choke section cannot, realistically, fit together perfectly. Some thin layer of air surround the layer of dielectric, which combination will then determine the electrical length of the choke assembly. The combination of air and solid dielectric results in an "effective dielectric constant" smaller than the dielectric constant of the solid dielectric material alone. Normally, the designer of such connectors would try to make the thickness of the air dielectric layer as small or as close to zero as possible. According to an aspect of the invention, the width of the air space is significant, and can have the same order of magnitude of thickness as the solid dielectric, which provides for lateral misalignment of the two halves of the connector during mating. This is a salient advantage of this embodiment of the invention. In such embodiment, there is the possibility of relative lateral misalignments between the halves of the mating connectors of an array or gang. In order to allow ganged mating of arrayed choke connectors, the dimensions of the connector halves may be selected to provide some tolerance. More particularly, the following dimensions were selected:

| | |
|---|---|
| $D_1$ | 0.071 inch |
| $D_2$ | 0.163 |
| $D_3$ | 0.027 |

-continued

| | |
|---|---|
| $D_4$ | 0.207 |
| $D_5$ | 0.041 |
| $D_6$ | 0.051 |
| $D_7$ | 0.183 |
| $D_8$ | 0.197 |
| outer diameter | 0.227 |

Figures 6A, 6B:
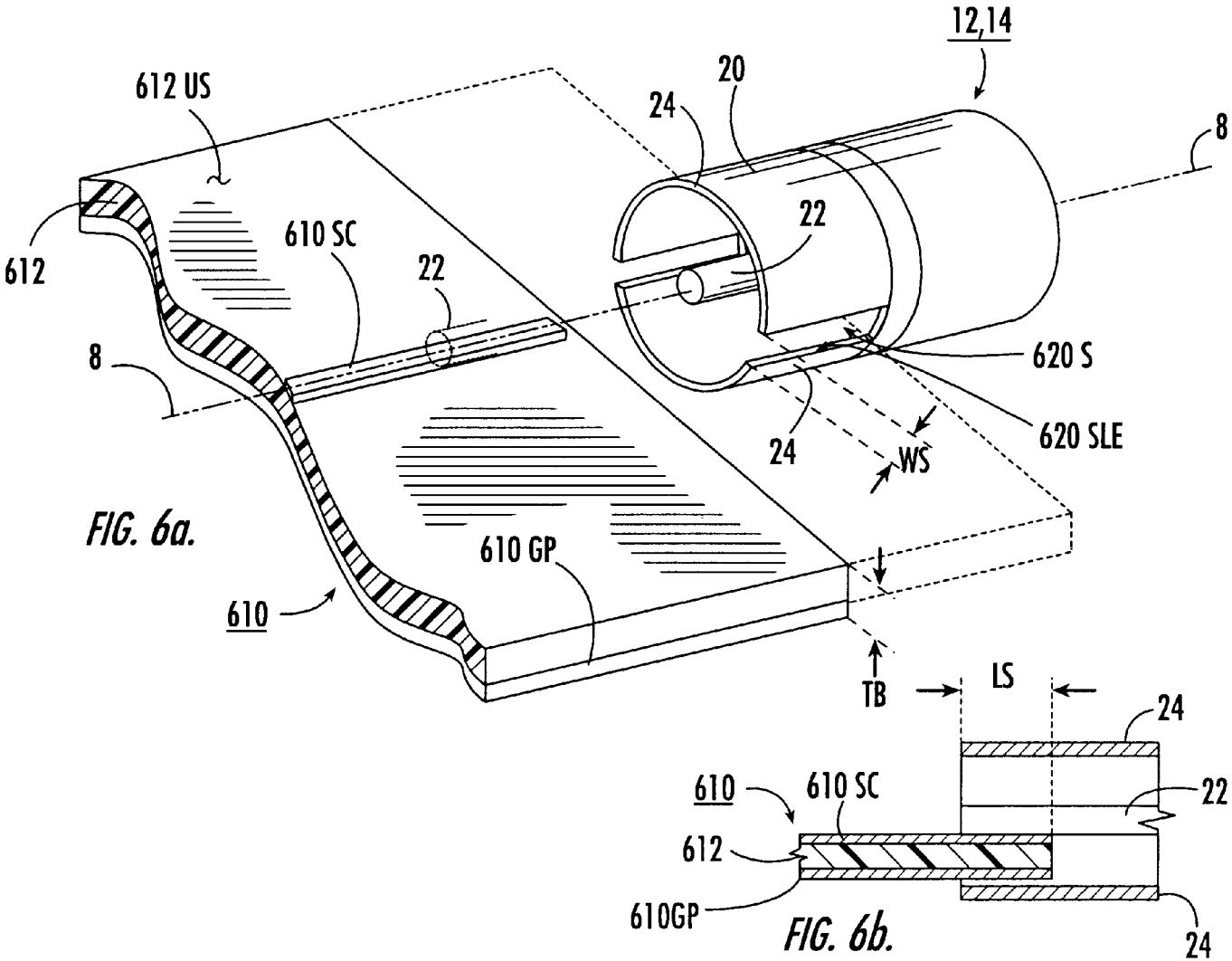
FIG. 6*a* is a simplified perspective or isometric illustration of one way to connect a microstrip transmission line to a coaxial transmission line end of a connector according to the invention.
FIG. 6*b* is a cross-section of a portion thereof.

FIG. 6*a* is a simplified exploded illustration of one way to connect a microstrip transmission line to a coaxial transmission line end of a connector according to the invention, and FIG. 6*b* is a cross-sectional view of the structure of FIG. 6*a* in its assembled form. In FIGS. 6*a* and 6*b*, both male and female connector portions 12 and 14 terminate in a coaxial transmission line 20, so FIGS. 6*a* and 6*b* apply to both. In FIG. 6*a*, the portion 20 of coaxial transmission line includes elongated center conductor 22 concentric with outer conductor 24. In the relevant portion of the coaxial transmission line 20, the dielectric medium is air. A pair of aligned slots 620S are cut into the end of outer conductor 24, with the upper edges of the slots coincident with the lower edge of center conductor 22. The width WS of each slot 620S is equal to the thickness TB of a printed-circuit board 610. Printed circuit board 610 includes a ground plane 610GP and a strip conductor 610SC spaced therefrom by a dielectric medium 612, as is commonly used for radio frequency (RF) transmission. In this instance, the type of transmission line is often called microstrip. Microstrip differs from "stripline" in that stripline has the strip conductor sandwiched between two spaced-apart ground conductors or ground planes. When assembled, the printed-circuit board 610 of FIG. 6*a* fits into the slots 620S in the outer conductor of the coaxial transmission line 20, with strip conductor 610SC extending under center conductor 22. The assembled structure is illustrated in FIG. 6*b*. With the two structures juxtaposed, the conductors can be mechanically connected by an electrically conductive material, such as solder, silver solder, brazing, or possibly jumpers. The center conductor 22 is connected to strip conductor 610SC along the length of their juxtaposition, designated as the solder length (LS) in FIG. 6*b*. The ground plane 610GP is similarly connected to the lower edges 620SLE of the slot 620S by some electrically conductive material. If the characteristic impedance of the microstrip transmission line equals that of the coaxial transmission line 20, the impedance discontinuity should be small. Such a connection is not optimum, as there may be some inductive or capacitive discontinuity components near the location of the connection. These can be compensated in known fashion, as for example by enlarging or diminishing the diameter of the center conductor of the coaxial transmission line in the affected region. In the arrangement of FIGS. 6*a* and 6*b*, the connector 12 or 14 is supported by the mechanical connections between the strip conductor and the center conductor, and between the ground plane and the outer conductor.

Figure 7:
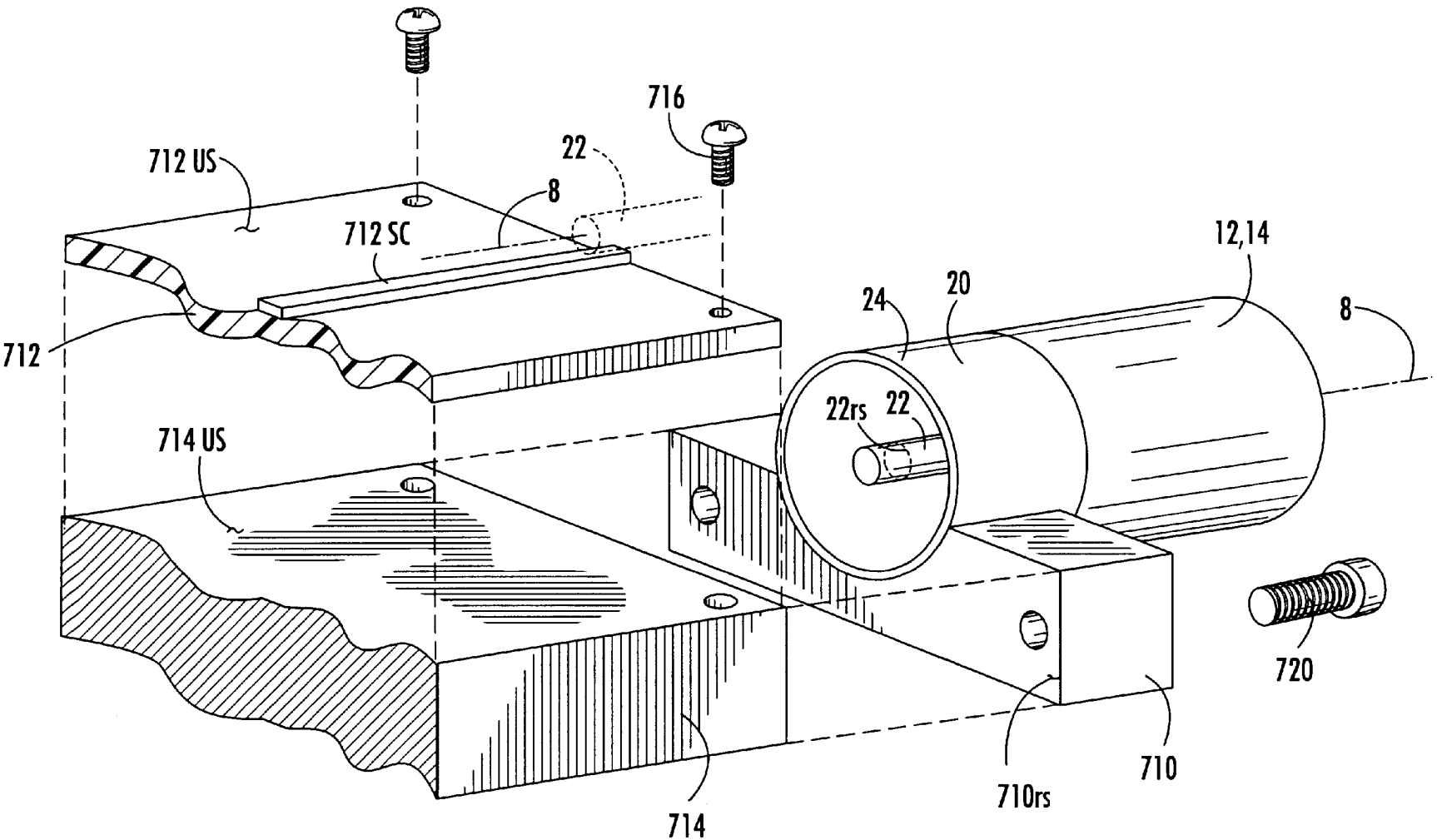
FIG. 7 is a simplified perspective or isometric illustration of another way to connect a microstrip transmission line to a coaxial transmission line end of a connector according to the invention.

FIG. 7 illustrates another way to make a connection between a microstrip transmission line and the coaxial transmission line end of a connector according to an aspect of the invention. In FIG. 7, the connector/transmission line 12,14/20 is supported by a block 710 which has a planar rear surface or face 710*rs* which is coincident with the plane defining the end of the outer conductor 24. The center conductor 22 extends beyond the plane of surface 710*rs*, as may be noted by the dash-line intersection 22*rs* defined on the center conductor. In the arrangement of FIG. 7, the microstrip transmission line is defined by a strip conductor 712SC lying on the upper surface 712US of a dielectric sheet or board 710. The ground plane for strip conductor 710SC is provided by a further electrically conductive block 714 having an upper surface 714US onto which the dielectric sheet 712 is applied or attached, as by screws, one of which is designated 716. The vertical-direction height of block 714 is greater than that of block 710, so that when the structure is assembled, the strip conductor 712SC lies just under that portion of center conductor 22 which projects beyond the plane of surface 710*rs*. The center conductor 22 can be connected to strip conductor 712SC by the same methods described in conjunction with FIG. 6, and the ground plane needs no additional connection, as the block 714 itself is the ground plane for the microstrip transmission line, and block 714 is affixed to block 710, as with screws 720, at appropriate location. In an arrangement such as that of FIG. 7, the relatively large capacitance between juxtaposed blocks 710 and 714 may tend to reduce the need for actual mechanical contact across the entire joined surfaces.

It should be understood that, while the printed circuit boards of FIGS. 6*a* and 6*b* are simple "double-sided" boards (boards having electrically conductive traces or paths on both upper and lower surfaces), it may often be desirable to use a multilayer printed circuit board, and to have the relevant RF traces "buried" within inner layers of the board. In such a case, it will be necessary to cut away so much of the board as is needed to expose the RF strip conductor, so that a connection to the center conductor of the coaxial transmission line can be achieved. Similarly, some access to the RF ground plane will be necessary. Such access may be achieved by plated through vias, as is known from high density interconnect (HDI) techniques and structures.

Figure 8A:
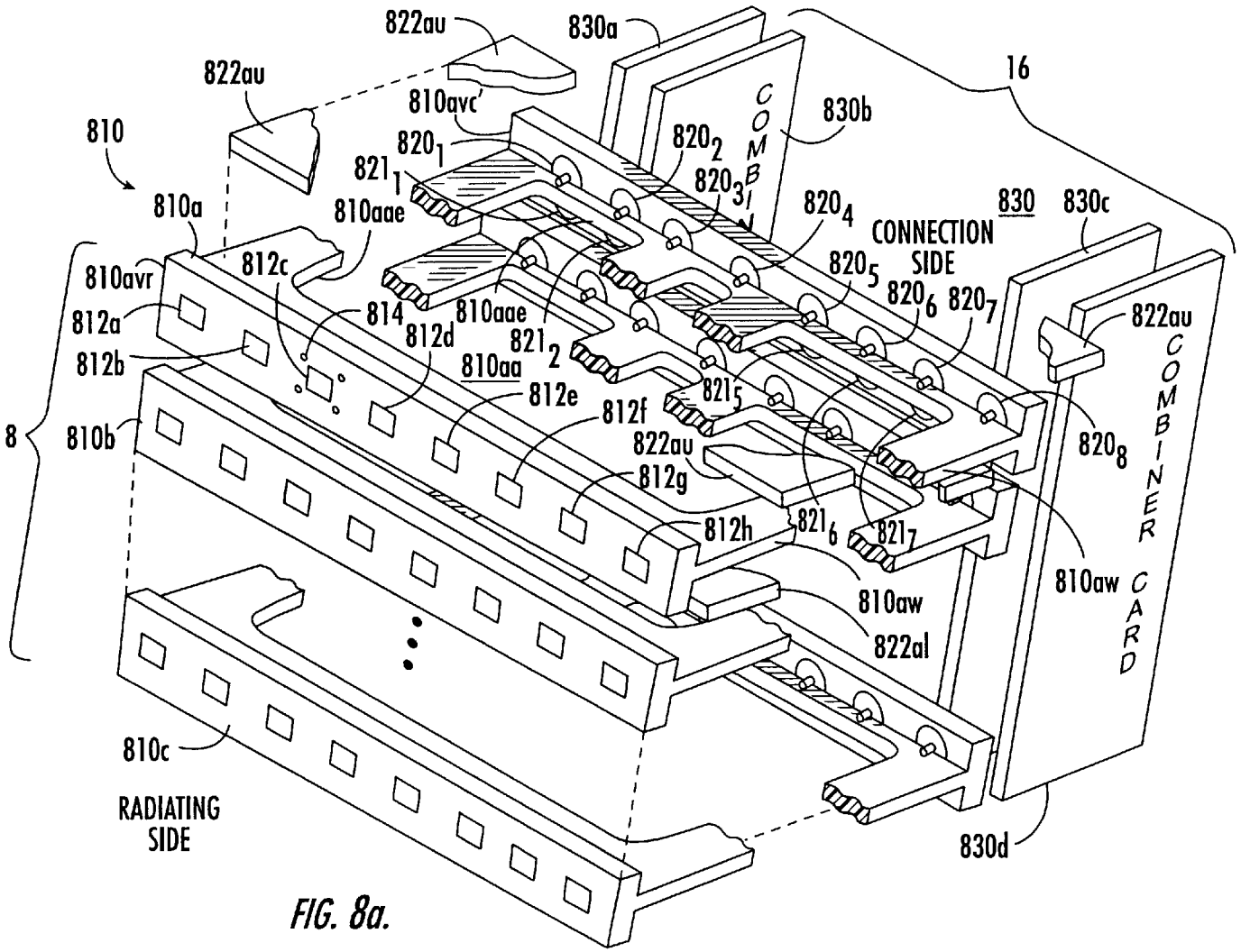
FIG. 8*a* is a simplified perspective or isometric view of a stack of frames representing a portion of a receiver, and the associated combiner boards.

FIG. 8*a* is a simplified perspective or isometric view, partially exploded and sectioned, illustrating an application in which connectors according to the invention may be used. In FIG. 8*a*, a set 810 of "ribs" or frames 810*a*, 810*b*, . . . , 810*c* are stacked vertically. The illustrative number of frames is selected to be eight, but other numbers are possible and even likely. Each frame is identical to the others. The external support for holding the frames in position within the set is not illustrated. The frames of set 810 of frames of FIG. 8*a* provide coupling for a waveguide source of RF, support for one or more printed circuit boards carrying such elements as low-noise amplifiers, filters and downconverters, and also carrying a beamformer for generating an antenna beam from the signal arriving at the waveguide ports of that frame. In addition, the frames of set 810 of frames also provide support for choke-coupled connectors which allow the combining of the beams generated by the various frames. Uppermost frame 810*a* is described as a typical unit. Frame 810*a* of FIG. 8 includes a vertically disposed radiating-side flange portion 810*avr*, which defines a set 812 of a plurality of rectangular or square waveguide apertures 812*a*, 812*b*, 812*c*, 812*d*, 812*e*, 812*f*, 812*g*, and 812*g*, to which waveguide flanges may be fastened in the usual manner, as suggested by the set of threaded apertures, one of which is designated 814, associated with aperture 812*c*. Frame 810*a* also includes a vertically disposed connection-side flange 810*avc*. A web member 810*aw* of frame 810*a* extends horizontally between the center of radiating side vertical flange 810*avr* and the center of connection side vertical flange 810*avc*. Thus, each flange extends above and below the web portion. Web portion 810*aw* defines a plurality of apertures 810*aa*, which leave edges 810*aae*. The apertures 810*aa* do not extend to the edge of the various frame, so there is a straight peripheral portion of the frame at all locations therearound.

Frame 810*a* of FIG. 8 defines a plurality or set 820 of apertures through that portion of upstanding or vertical flange portion 810*avc* extending above web portion 810*aw*. The number of such apertures is selected as eight, for simplicity, although in a particular embodiment, the number is sixteen. The eight apertures are designated $820_1$, $820_2$, $820_3$, $820_4$, $820_5$, $820_6$, $820_7$, and $820_8$. Each aperture of set 820 contains, or is associated with, one choke-coupled coaxial connector as described in conjunction with FIGS. 1, 2, 3, 4, 6*a*, 6*b*, or 7. In the view of FIG. 8*a*, the "rear" or coaxial-transmission-line side of each connector is visible. Each aperture of set 20, then, includes an electrically conductive flange portion and a coaxial center conductor portion, which may or may not protrude past the associated surface of the flange 810*avc*.

At least some of the radiation-receiving waveguide apertures 812*a*, 812*b*, 812*c*, 812*d*, 812*e*, 812*f*, 812*g*, and 812*g* of set 812 include probes or other coupling portions for coupling signals to the upper side of web portion 810*aw*. An "upper" printed-circuit board designated 822*au* is mounted atop web portion 810*aw* of frame 810*a*, and receives the signals from the waveguide apertures of set 812 of apertures. The printed circuit 822*au* may be a multilayer printed circuit, as mentioned above. Printed circuit 822*au* makes connection to, and may wholly or partially support, the low-noise amplifiers, filters, and downconverters or detectors associated with analog processing of the eight separate received signals arriving from the eight RF apertures of set 812 of apertures. The term "separate" in this context means that they arise from separate sources, although the sources may be related. In this particular arrangement, the eight sources are horn receiving antennas (not illustrated), each of which is coupled to one of the apertures 812*a*, 812*b*, 812*c*, 812*d*, 812*e*, 812*f*, 812*g*, and 812*g* of set 812. Thus, the printed circuit board 822*au*, lying on the upper surface of web 810*aw* of uppermost frame 810*a*, handles eight signals associated with the RF apertures 812*a*. In addition to processing the received signals, printed circuit board 822*au* also includes summing and combining circuits which together define a beamformer (not separately shown), for generating eight separate beams from the eight received RF signals. The eight separate beams are represented by signals which are produced by the beamformer associated with printed circuit board 822*au*. The eight separate signals from printed circuit board 822*au* are applied to signal paths represented by apertures $820_1$, $820_2$, $820_3$, $820_4$, $820_5$, $820_6$, $820_7$, and $820_8$ of set 820 of apertures. Thus, eight separate beams formed from the eight apertures of set 812*a* are applied to the connectors associated with set 820 of apertures.

In addition to upper printed circuit board 822*au* mounted above web 810*aw* of frame 810*a* of FIG. 8, a second or lower printed circuit board 822*al*, only a portion of which is visible, is mounted to the lower surface of web 810*aw* of frame 810*a*. This lower printed circuit board 822*al* is also connected to receive signal from the eight RF waveguide apertures 812*a*, 812*b*, 812*c*, 812*d*, 812*e*, 812*f*, 812*g*, and 812*g* of set 812. This lower printed circuit board also supports and interconnects various low noise amplifiers, filters, downconverters, and also includes a beamformer for generating eight additional antenna beams from the RF signals arriving at the apertures of set 812. Thus, a total of sixteen signals representing sixteen separate antenna beams are generated by the combination of the upper printed circuit board 822*au* and the lower printed circuit board 822*al*. Just as the signals representing the eight separate beams generated by the upper printed circuit board were coupled to the transmission lines or connectors associated with apertures $812_1$, $820_2$, $820_3$, $820_4$, $820_5$, $820_6$, $820_7$, and $820_8$ of set 820 of apertures, the signals representing the eight separate beams generated by the lower printed circuit board are coupled to the transmission lines or connectors associated with a second set 821 of eight apertures. The apertures of second set 821 include $\mathbf{821}_1$, $\mathbf{821}_2$, . . . , $\mathbf{821}_5$, $\mathbf{821}_6$, $\mathbf{281}_7$, . . . . Each aperture of set 821 lies immediately below the associated or like-indexed aperture of set 820. More particularly, aperture 821 lies immediately below aperture $\mathbf{812}_1$, aperture $\mathbf{821}_2$ lies immediately below aperture $\mathbf{820}_2$, aperture $\mathbf{821}_5$ lies immediately below aperture $\mathbf{820}_5$, and aperture $\mathbf{821}_7$ lies immediately below aperture $\mathbf{820}_7$. Thus, the aperture pairs are separated only by the thickness of the web. More particularly, aperture $\mathbf{820}_1$ lies above aperture $\mathbf{821}_1$ by only the thickness of the web. Thus, they are very closely spaced, so the associated choke-coupled connectors must also be very closely spaced.

Those skilled in the art will recognize that those frames 810*b*, . . . , 810*c* not discussed in detail in conjunction with FIG. 8 are similar to frame 810*a*, and require no further elaboration. Each of the eight frames receives eight RF input signals, and produces sixteen beams therefrom. Thus, the "backplane' of the frame stack 810 of FIG. 8 may be expected to have 122 connectors, each associated with one antenna beam.

Figures 8B, 8C:
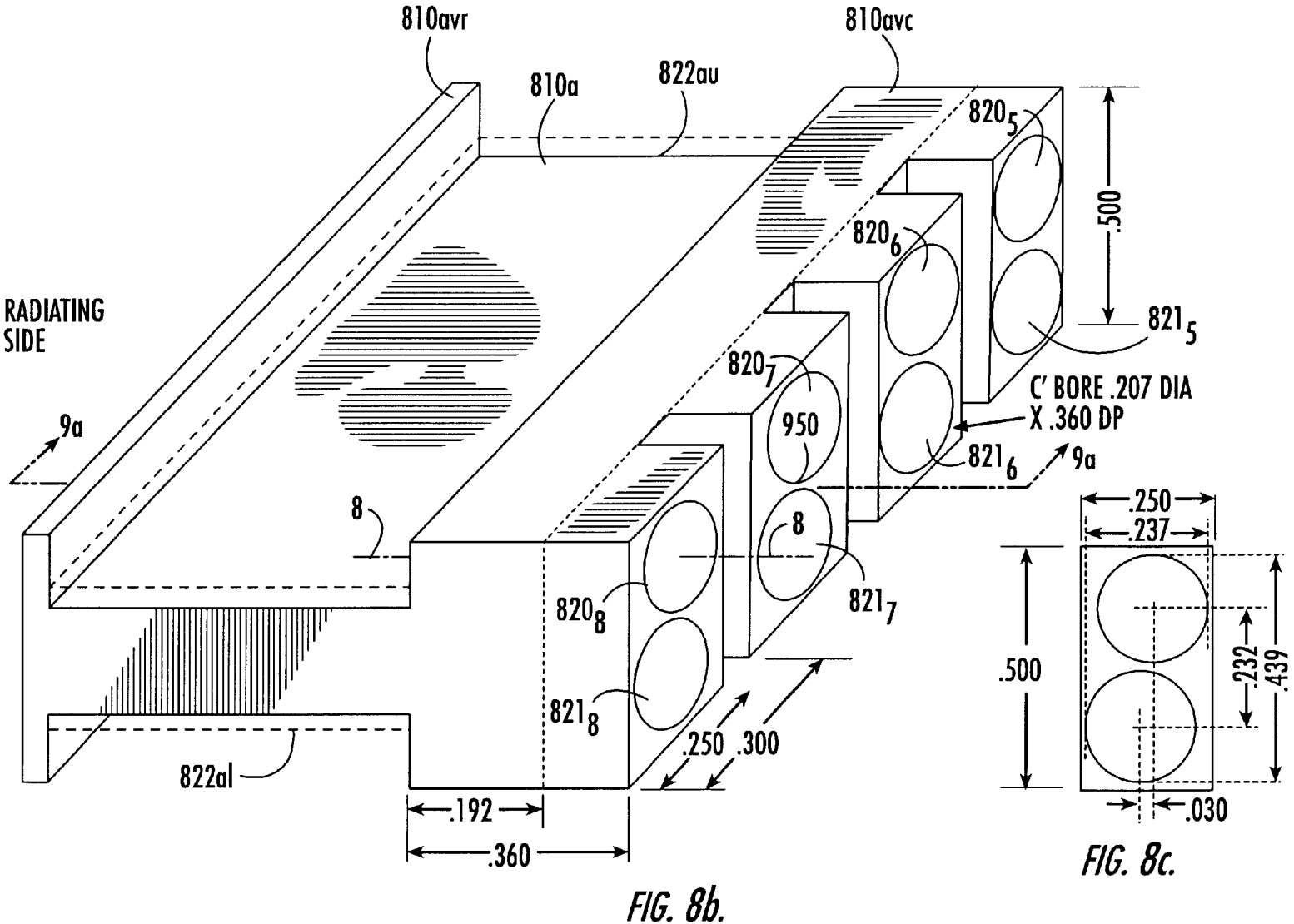
FIG. 8*b* is a simplified perspective or isometric view of a portion of one frame of the stack of FIG. 8*a*.
FIG. 8*c* is an end view of two apertures of the structure of FIG. 8*b;*

FIG. 8*b* includes a simplified perspective or isometric view of uppermost frame member 810*a* of FIG. 8*a*, and FIG. 8*c* is an end-on view of one pair of apertures. In FIG. 8*b*, the view illustrates the apertures of sets 820 and 821 as seen from the connection side of the frame, and includes dimensions associated with a particular embodiment of the invention. Each upper aperture $\mathbf{820}_5$, $\mathbf{820}_6$, $\mathbf{820}_7$, and $\mathbf{820}_8$ and corresponding lower apertures $\mathbf{821}_5$, $\mathbf{821}_6$, $\mathbf{821}_7$, and $\mathbf{821}_8$ will be understood to be associated with either a male or female portion of a choke-coupled connector such as described above. FIGS. 8*b* and 8*c* aid in understanding that the spacing of the various connectors, as indicated by the spacing of the apertures of sets 820 and 821 with which they are associated, is very close.

In operation of a receiver such as that of the arrangement of FIG. 8*a*, the various beams generated by the various frames 810*a*, 810*b*, . . . , 810*c* must be combined to form different antenna beams. Those skilled in the antenna arts know that the purpose of this combining is to narrow the beams in a second plane, orthogonal to the plane in which narrowing was accomplished by the beamformers associated with the various printed circuit boards 822*au*, 822*al*, and the like. The additional beamforming can also be called "combining." In FIG. 8, a "stack" 830 of eight combiner cards 830*a*, 830*b*, . . . , 830*d*, 830*c* is arranged with their edges adjacent the rear or backplane of the stack 810 of frames. Each combiner card combines signals from a limited number of the output ports of all of the frames of set 810 of frames. More particularly, the first combiner card 830*a* includes choke-coupled connectors for making connection to those connector portions associated with upper and lower apertures $\mathbf{820}_1$ and $\mathbf{821}_1$ of the uppermost frame 810*a*, and also includes choke-coupled connectors for making connection to those connector portions associated with the apertures of the other frames of set 810, which correspond to their respective upper and lower apertures $\mathbf{820}_1$ and $\mathbf{821}_1$. Thus, combiner card 830*a* makes two connections to uppermost frame 810*a*, and also makes two connections to each of the other eight frames, for a total of sixteen connections. Similarly, combiner card 830*b* includes choke-coupled connectors for making connection to those connector portions associated with upper and lower apertures $\mathbf{820}_2$ and $\mathbf{821}_2$ of the uppermost frame 810*a*, and also includes choke-coupled connectors for making connection to those connector portions associated with the apertures of the other frames of set 810, which correspond to their respective upper and lower apertures $\mathbf{820}_2$ and $\mathbf{821}_2$. Thus, each of the other combiner cards of set 830 also makes sixteen connections.

Figure 9A:
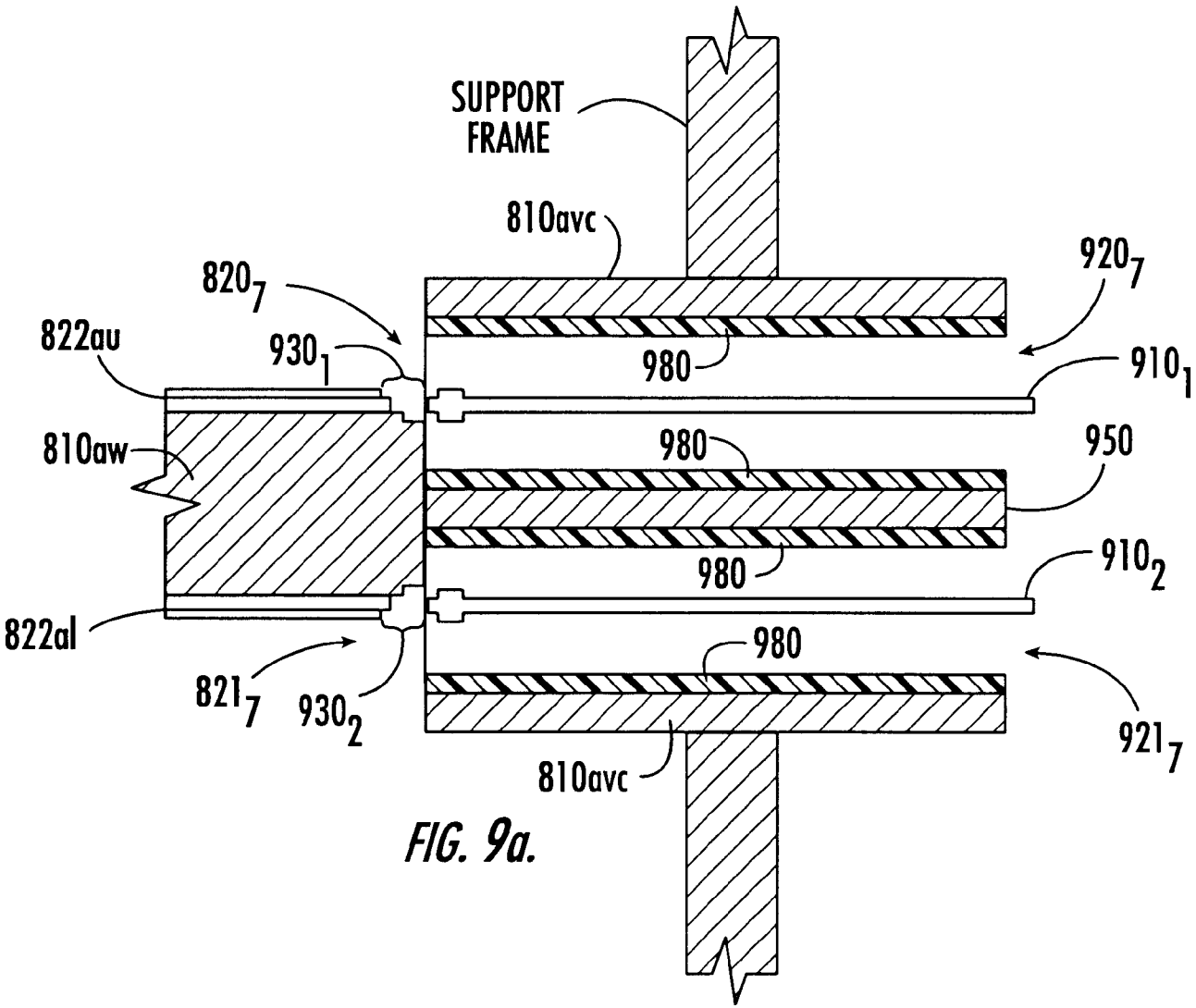
FIGS. 9*a* and 9*b* are skeletonized, simplified cross-sectional views of the connections of two coaxial choke connectors according to an aspect of the invention, in the context of the arrangement of FIGS. 8*a* and 8*b;*

FIG. 9*a* is a simplified, skeletonized cross-section of a portion of the structure of FIG. 8*b* taken at section lines 9*b*—9*b*. FIG. 9*a* illustrates how the two printed circuit boards associated with exemplary frame 810*aw* of FIG. 8*a* make connection to the choke-coupled connectors. In FIG. 9*a*, the cross-section includes a portion of frame or rib 810*aw*, with printed circuit boards 822*au* and 822*al* mounted above and below the rib. The upper aperture $\mathbf{820}_7$ overlies lower aperture $\mathbf{821}_7$. As illustrated, the support frame is thinned by comparison with the illustration of FIG. 8. A jumper illustrated as $\mathbf{930}_1$ couples a strip conductor associated with upper printed circuit board 822*au* to the male choke center conductor $\mathbf{910}_1$ of the connector portion associated with aperture $\mathbf{820}_7$, and a similar jumper $\mathbf{930}_2$ couples a strip conductor associated with lower printed circuit board 822*al* to the male choke center conductor $\mathbf{910}_2$ of the connector portion associated with aperture $\mathbf{821}_7$. That portion of the structure designated 950 represents a portion of the support structure which lies between the two apertures. In FIG. 9*a*, the upper male choke-coupled connector portion is designated $\mathbf{920}_7$, and the corresponding lower male choke coupled connector portion is designated $\mathbf{921}_7$. Also in FIG. 9*a*, a layer 980 of dielectric material is applied to or covers at least a portion of the inner surface of the outer conductor of the male connectors.

Figure 9B:
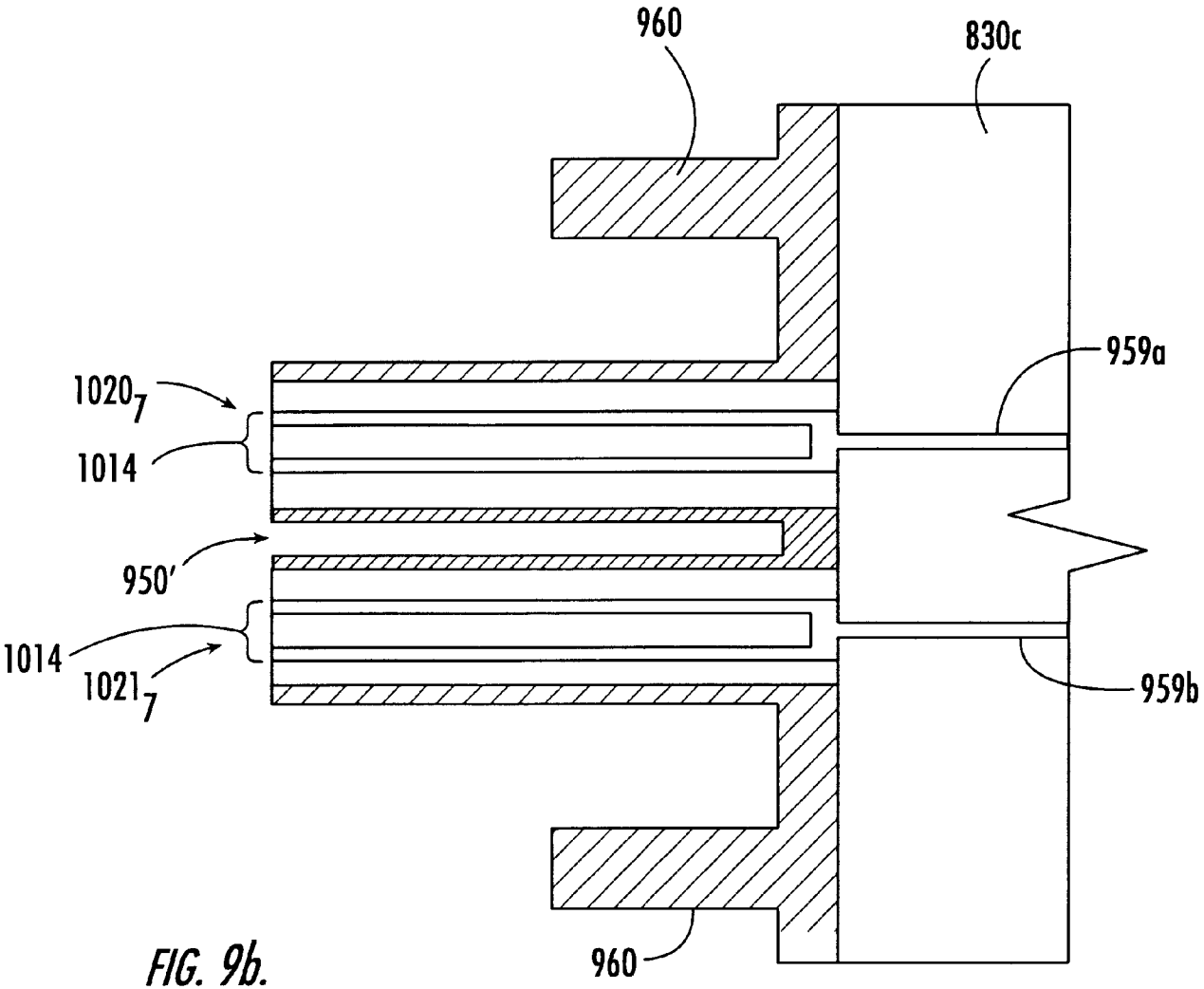

FIG. 9*b* is a simplified, skeletonized cross-section of a portion of combiner board 830*c* of FIG. 8*a* and its associated female connector portions $\mathbf{1020}_7$ and $\mathbf{1021}_7$, for making connection to the male connector portions $\mathbf{920}_7$ and $\mathbf{921}_7$ associated with FIG. 9*a*. In FIG. 9*b*, a portion of combiner board 830*c* lying near the connectors is shown, together with a structural portion 960 which supports the combiner board and the connectors, and which is integral with exterior conductor portions of the female connector portions $\mathbf{1020}_7$ and $\mathbf{1021}_7$. In FIG. 9*b*, an aperture 950' corresponds to portion 950 lying between the male connectors in FIG. 9*a*. Elements 1014 each correspond to the center choke conductor 250 of FIG. 2. It will be clear that when the combiner board is mated with the stack 810, rotation of a male or female portion of any one choke-coupled connector of the structure is not possible, as this would require all the other choke-coupled connectors to fail laterally.

Figure 11:
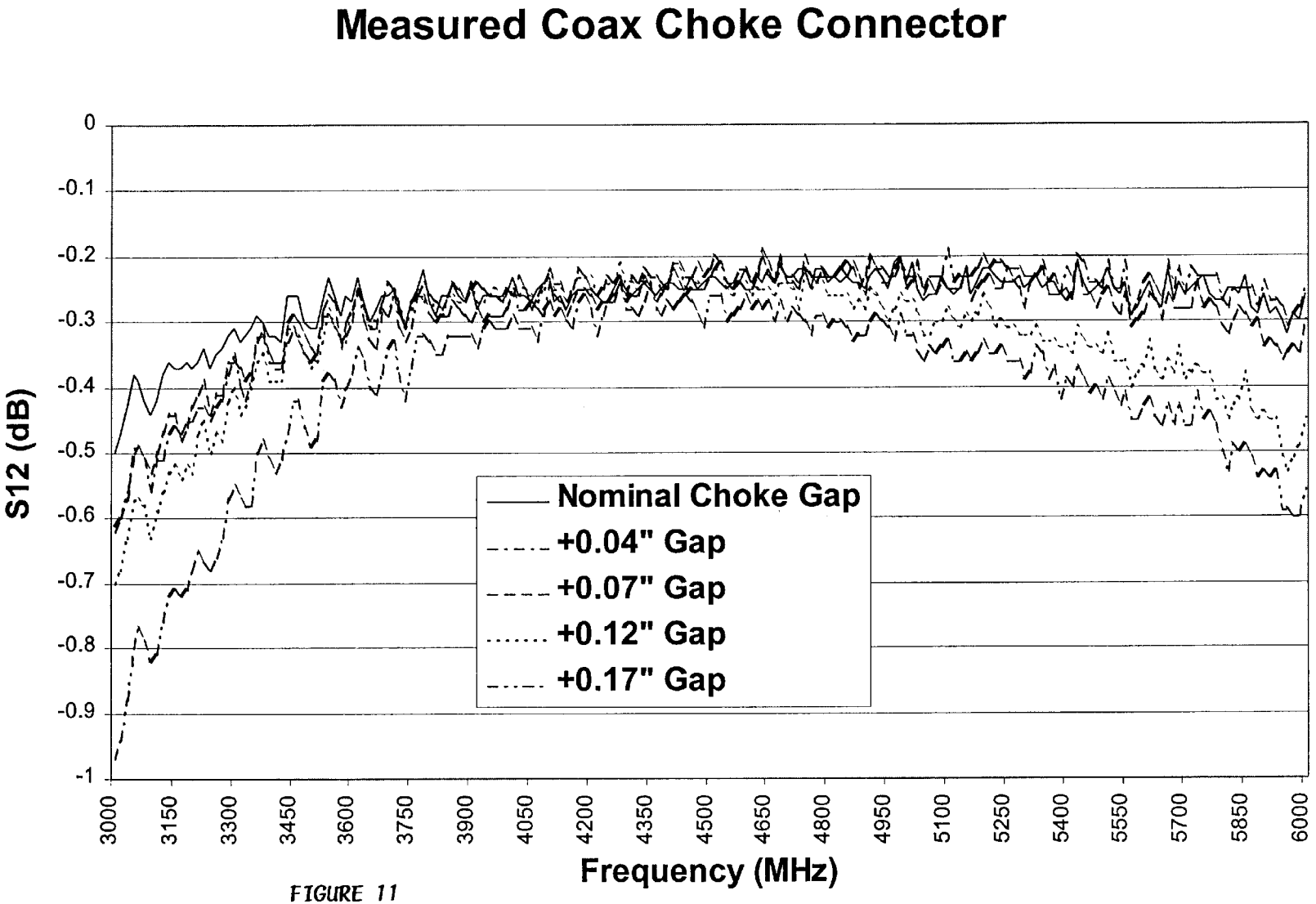
FIG. 11 plots the measured through loss of a mated choke connector pair for various axial mismatches providing particular gap lengths.

FIG. 11 plots the through loss $S_{12}$ in dB for a mated connector according to FIGS. 1, 2, or 3, for various degrees of mismating as represented by gap width, and over a frequency range of 3000 to 6000 GHz. In FIG. 11, the loss for the nominal gap width is represented by a solid line plot. The solid-line plot defines a nominal through loss of about 0.25 dB in the center of the frequency band, dropping off to about 0.5 dB at 3000 GHz. For axial misalignments resulting in a gap of 0.04 and 0.07 inch, the through loss performance is not much affected, even at the band edges. Axial misalignments giving a gap of 0.12 and 0.15 inch have little effect mid-band, but tend to have higher losses near the band edges.

Figure 12:
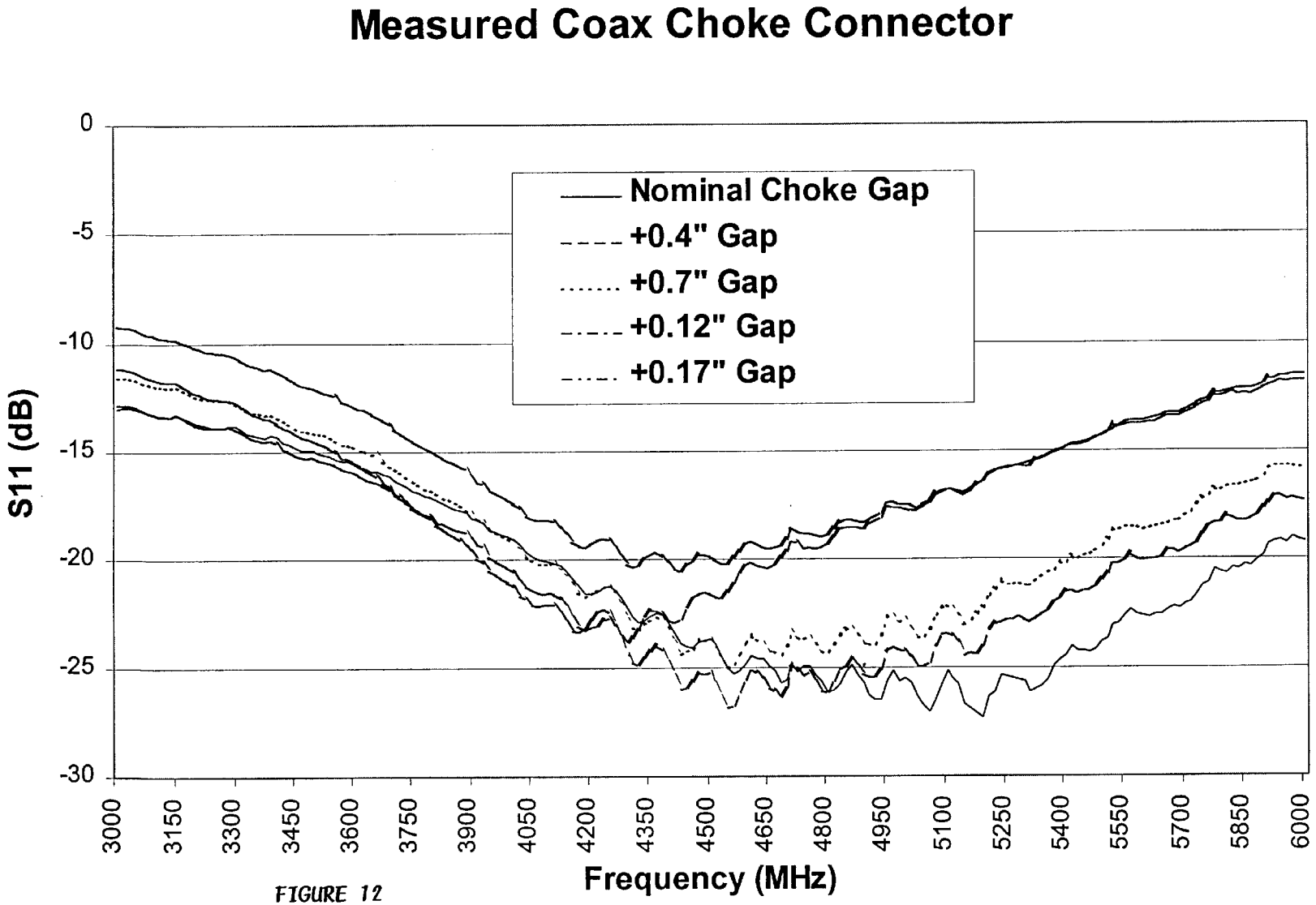
FIG. 12 plots impedance mismatch for a mated choke connector pair having the same group of axial mismatches as in FIG. 11.

FIG. 12 plots impedance mismatch in the form of return loss or $S_{11}$ over the range of 3000 to 6000 GHz for the same group of axial mismatches as in FIG. 11. In FIG. 12, the return loss is greater than 20 dB in the center of the band for the fully mated and the axially mismatched connectors. At the lower edge of the band, the fully mated connector exhibits a return loss of about 13 dB, and the axially misaligned go as high as 9 dB. At the high end of the band, however, only the two most mismated connector conditions exhibit return loss less than 15 dB.

Figure 13:
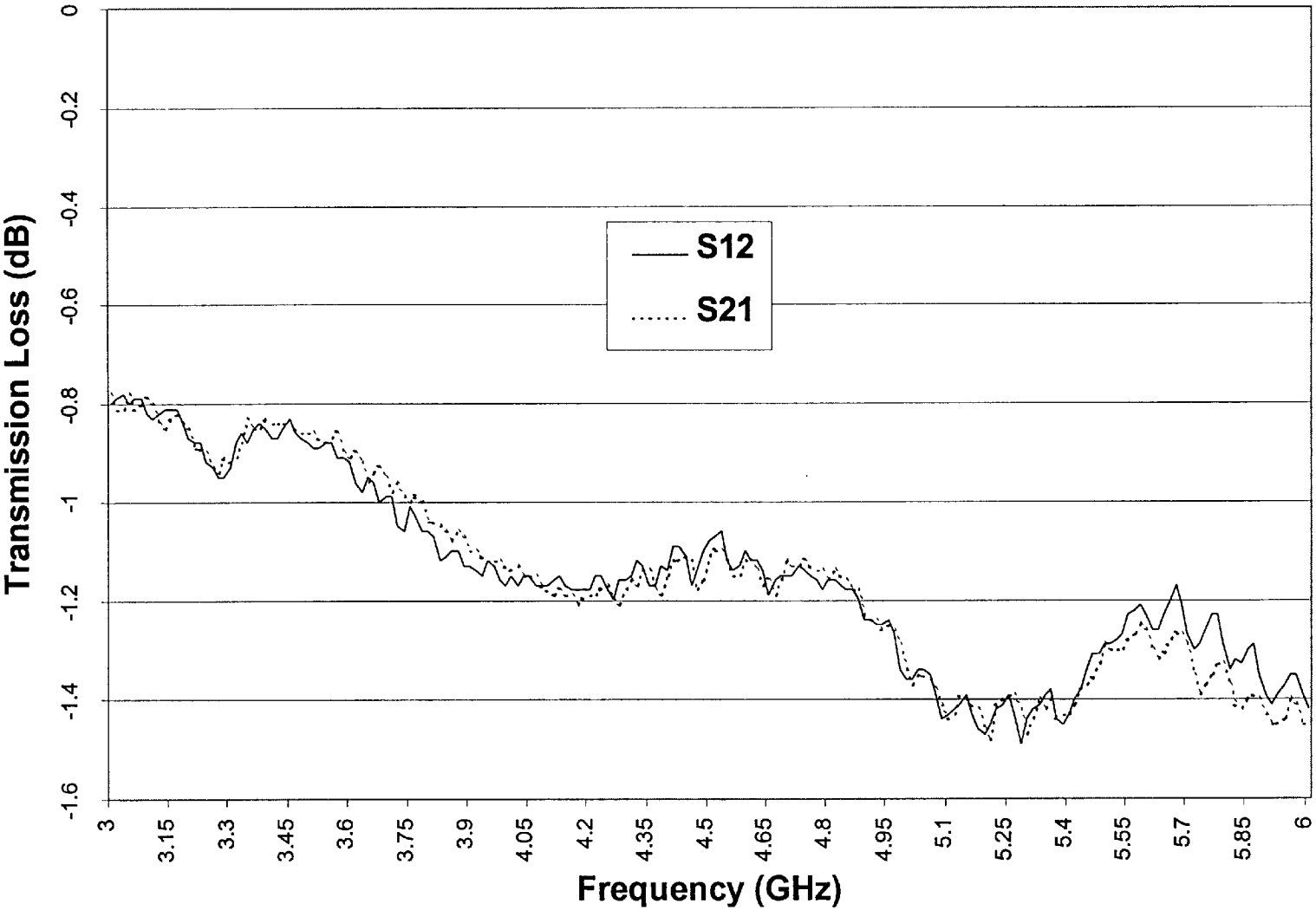
FIG. 13 plots through loss in both directions for a mated choke connector with a microstrip transmission line mounted on each end in the manner suggested in FIGS. 6*a*, 6*b*, or 7.

FIG. 13 plots through loss in both directions for a mated choke connector with a microstrip transmission line mounted on each end in the manner suggested in FIGS. 6*a*, 6*b*, or 7, over the range of 3000 to 6000 GHz. More particularly, The solid-line plot represents the transmission loss in a first direction through a microstrip line coupled to one portion of a choke-coupled connector according to an aspect of the invention, which one portion is mated to another portion of a choke-coupled connector, which in turn is coupled to a second microstrip line similar to the first. In other words, the through loss is that of a cascade of a microstrip line, a mated choke-coupled connector, and another microstrip line. The dotted plot represents the through loss in the opposite direction. Ideally, both plots should overlap, and any deviation from overlap represents an imperfection in the measuring setup. As illustrated in FIG. 13, the through loss is about 0.8 dB at the lower end of the frequency band, and increases to about 1.4 dB at the upper end of the band. An increase of losses with increasing frequency is to be expected due to the normal characteristics of transmission lines. The presence of the mated connector does not appear to cause great deviation of the trend of the plots.

Figure 14:
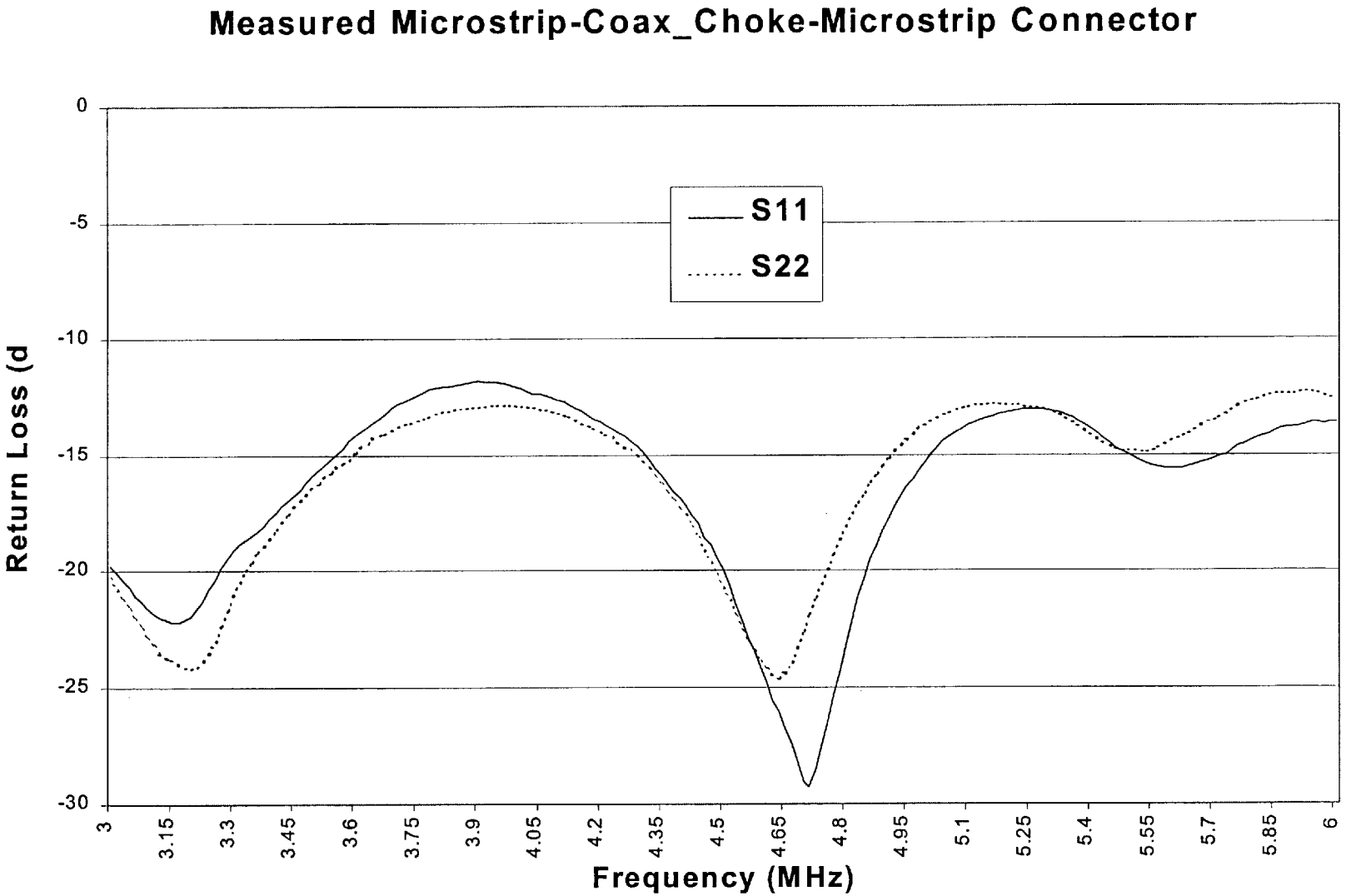
FIG. 14 plots impedance mismatch in the form of return loss in the same microstrip-connector-microstrip configuration as that of FIG. 13.

FIG. 14 plots impedance mismatch in the form of return loss in the same microstrip-connector-microstrip configuration as that of FIG. 13. In FIG. 14, the solid line plot represents the return loss looking into one microstrip port, and the dotted line represents the return loss looking into the other microstrip port. As illustrated, the worst return loss over the band is about 12 dB.

Figure 15:
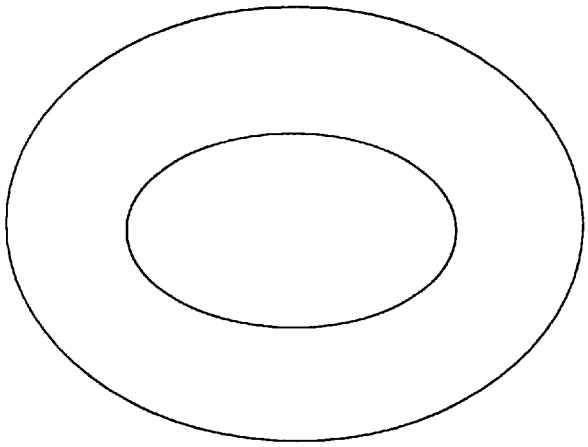
FIGS. 15 and 16 illustrate alternative ovoid and rectangular, respectively, choke connector cross-sections.
Figure 16:
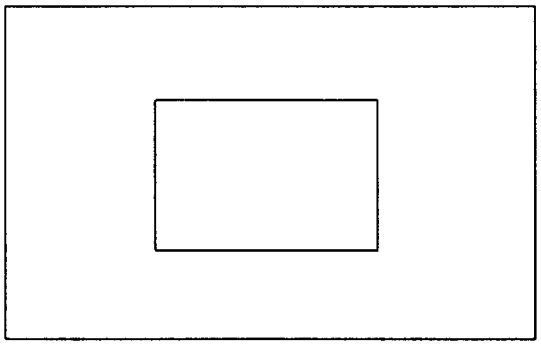

FIG. 15 illustrates in a general fashion a cross-section through a choke-coupled connector according to an aspect of the invention, in which the cross-section is elliptical. More particularly, the outer ellipse or ovoid in FIG. 15 represents the outer choke conductor of either the male or female portion of the connector, and the inner ellipse or ovoid represents the inner choke conductor. In such an elliptical or ovoid structure, the cross-section in either principal or minor plane in the case of an ellipse or "principal" or "minor" plane in the case of an ovoid resembles the structure of FIG. 3, with the only differences between the two planes being a scale factor in FIG. 3. FIG. 16 similarly represents a choke-coupled connector having a rectangular cross-section (which could also be square). A cross-section along either axis of the rectangular structure of FIG. 16 would also resemble the cross-section of FIG. 3, again with a scale factor except in the case of a square.

Other embodiments of the invention will be apparent to those skilled in the art. For example, while a circularly symmetric connector has been described, those skilled in the art will recognize that the cross-sectional shape of the connector could be a polygon other than a rectangle, so long as rotational positioning limitations are acceptable. The coaxial transmission lines with which the connector according to the invention is used may be rigid, semirigid, or flexible. While no insulative material has been illustrated as being associated with the steps 210S, 220S, 260S, or bore end wall 250BE, electrical insulation may be used at any or all of these locations, and on the exterior of the outer conductors of the coaxial transmission line 20.

Thus, a coaxial choke connector (11) according to an aspect of the invention is for use with a coaxial transmission line (20*a*, 20*b*) having a characteristic impedance defined by an exterior first diameter ($D_1$) of an inner conductor (22) and an interior second diameter ($D_2$) of an outer conductor (24). The coaxial choke connector (11) includes a male portion (12) and a female portion (14). The male portion (12) of the coaxial choke connector (11) includes an electrically conductive center choke conductor (210) defining a proximal end and a distal end, and an electrically conductive outer choke conductor also defining a proximal end and a distal end. The proximal end of the center choke conductor (210) is coupled to the inner conductor of the coaxial transmission line (20*a*, 20*b*), and the proximal end of the outer choke conductor is coupled to the outer conductor of the coaxial transmission line (20*a*, 20*b*). The center choke conductor (210) of the male portion (12) of the coaxial choke connector (11) has a first length, a circular cross-section centered on a longitudinal axis, and a third diameter less than the first diameter ($D_1$). The outer choke conductor of the male portion (12) of the coaxial choke connector (11) has an inner fourth diameter which defines a circular cross-section centered on the axis and which is larger than the second diameter ($D_2$). In one version, the center choke conductor (210) of the male portion (12) has a layer of solid dielectric on the outer surface thereof, so that the center choke conductor (210) with the layer of solid dielectric thereon has a fifth diameter smaller than the first diameter ($D_1$). In another avatar, a layer (980) of solid dielectric material lies on the interior surface of the outer choke conductor (220) of the male portion (12).

The female portion (14) of the coaxial choke connector (11) includes an electrically conductive center choke conductor (250) and an electrically conductive outer choke conductor. The inner choke conductor of the female portion (14) of the coaxial choke connector (11) defines a closed-end axial bore with respect to the longitudinal axis, and the axial bore has a second length and a sixth diameter larger than the fifth diameter. The center choke conductor (250) of the female portion (14) has an outer diameter equal to the first diameter ($D_1$). The outer choke conductor of the female portion (14) has an inner diameter equal to the second diameter ($D_2$), and in a third manifestation, an outer diameter coated with a solid dielectric material, so that the overall outer diameter of the outer choke conductor of the female portion (14), together with the solid dielectric material, has a seventh diameter, smaller than the fourth diameter. The coaxial choke connector (11) also includes a stop arrangement associated with the male and female portion (14)s of the coaxial choke connector (11), for allowing the male and female portion (14)s to mate, but without allowing galvanic contact between (a) the distal end of the center choke conductor (210) of the male portion (12) and the closed end (250BE) of the axial bore (250B) of the center choke conductor (250) of the female portion (14) and (b) the outer choke conductors ((220, 260, respectively) of the male (12) and female (14) portions of the coaxial choke connector (11). In yet another version, a layer (250I) of dielectric material lies against the inner surface of the bore (250B) of the center choke conductor (250) of the female portion (14).

In a particularly advantageous embodiment of the coaxial choke connector (11), at least one of (a) the distal end (214) of the center choke conductor (210) of the male portion (12) is tapered to a diameter smaller than the third diameter ($D_3$) and (b) the distal end (254) of the center choke conductor (250) of the female portion (14) is tapered to a thickness less than that existing over a portion of the center choke conductor (250) remote from the distal end (254). In yet a further improvement, the distal end (214) of the center choke conductor (210) of the male portion (12) extends beyond the plane ($P_{dm}$) of the distal end (224) of the outer choke conductor (220) of the male portion (12), for enhancing the ability to mate the male (12) and female portions of the coaxial choke connector (11).

The coaxial choke connector (11) may be used with any unbalanced transmission line having a characteristic impedance near, or preferably equal to, that of the coaxial choke connector (11). Such a transmission line might be stripline or microstrip.

What is claimed is:

1. A coaxial choke connector for use with a first transmission line having a characteristic impedance which, if the first transmission line were a coaxial transmission line, would be defined at least in part by an exterior first diameter of an inner conductor and an interior second diameter of an outer conductor, said coaxial choke connector comprising:

a male portion including an electrically conductive center choke conductor defining a proximal end and a distal end, and an electrically conductive outer choke conductor also defining a proximal end and a distal end, said proximal end of said center choke conductor being coupled to a first conductor of said first transmission line, and said proximal end of said outer choke conductor being coupled to a second conductor of said first transmission line, said center choke conductor of said male portion of said coaxial choke connector having a first length, a circular cross-section centered on a longitudinal axis, and a third diameter less than said first diameter, and said outer choke conductor having an inner fourth diameter which defines a circular cross-section centered on said axis, said fourth inner diameter being larger than said second diameter;

a female portion including an electrically conductive center choke conductor and an electrically conductive outer choke conductor, said inner choke conductor of said female portion of said coaxial choke connector defining a closed-end axial bore with respect to said longitudinal axis, said axial bore having a sixth diameter larger than a fifth diameter and a second length, said center choke conductor of said female portion having an outer diameter equal to said first diameter, said outer choke conductor of said female portion having an inner diameter equal to said second diameter;

a first layer of solid dielectric material lying on one of (a) the outer surface of said center choke conductor of said male portion so that said center choke conductor with said layer of solid dielectric thereon has said fifth diameter smaller than said first diameter and (b) the inner surface of said closed-end axial bore of said center choke conductor of said female portion; and a second layer of solid dielectric material lying on one of (a) an outer surface of said outer choke conductor of said female portion, so that the overall outer diameter of said outer choke conductor of said female portion together with said solid dielectric material has a seventh diameter, smaller than said fourth diameter and (b) an inner surface of said outer choke conductor of said male portion.

2. A connector according to claim 1, further comprising stop means associated with said male and female portions of said coaxial choke connector for allowing said male and female portions to mate without allowing galvanic contact between (a) said distal end of said center choke conductor of said male portion and said closed end of said axial bore of said center choke conductor of said female portion and (b) said outer choke conductors of said male and female portions of said coaxial choke connector.

3. A connector according to claim 1, further comprising holding means coupled to said male and female portions of said connector, for preventing significant relative rotation therebetween.

4. A connector according to claim 1, further comprising a narrowing taper of said distal end of said center choke conductor of said male portion, to thereby promote self-centering of said coaxial choke connector during mating.

5. A connector according to claim 1, further comprising a narrowing taper of said distal end of said outer choke conductor of said male portion, to thereby promote self-centering of said coaxial choke connector during mating.

6. A connector according to claim 1, wherein said distal end of said center choke conductor said male portion of said coaxial choke connector projects distally beyond the plane of said distal end of said outer choke conductor.

7. An array of coaxial choke connectors, each of said coaxial choke connectors being for use with a first transmission line having a characteristic impedance which, if associated with a coaxial transmission line, would be defined at least in part by an exterior first diameter of an inner conductor and an interior second diameter of an outer conductor, each of said coaxial choke connectors comprising:

a male portion including an electrically conductive center choke conductor defining a proximal end and a distal end, and an electrically conductive outer choke conductor also defining a proximal end and a distal end, said proximal end of said center choke conductor being coupled to a first conductor of said first transmission line, and said proximal end of said outer choke conductor being coupled to a second conductor of said first transmission line, said center choke conductor of said male portion of said coaxial choke connector having a first length, a circular cross-section centered on a longitudinal axis, and a third diameter less than said first diameter, and said outer choke conductor having an inner fourth diameter which defines a circular cross-section centered on said axis, said fourth inner diameter being larger than said second diameter, said center choke conductor having a layer of solid dielectric on the outer surface thereof, so that said center choke conductor with said layer of solid dielectric thereon has a fifth diameter smaller than said first diameter;

a female portion including an electrically conductive center choke conductor and an electrically conductive outer choke conductor, said inner choke conductor of said female portion of said coaxial choke connector defining a closed-end axial bore with respect to said longitudinal axis, said axial bore having a sixth diameter larger than said fifth diameter and a second length, said center choke conductor of said female portion having an outer diameter equal to said first diameter, said outer choke conductor of said female portion having an inner diameter equal to said second diameter, and an outer diameter coated with a solid dielectric material, so that the overall outer diameter of said outer choke conductor of said female portion together with said solid dielectric material has a seventh diameter, smaller than said fourth diameter;

said array further comprising first mechanical support means coupled to said male portions of said array of coaxial choke connectors for holding said male portions in a predetermined array spacing and orientation, second mechanical support means coupled to said female portions of said array of coaxial choke connectors for holding said female portions in said predetermined array spacing and an orientation conducive to mating with said male portions.

8. An array according to claim 7, further comprising third mechanical support means coupled to said first and second mechanical support means, for holding said first and second mechanical support means in a position in which said male and female portions of said array of coaxial choke connectors is mated.

9. A coaxial choke connector for use with a coaxial transmission line having a characteristic impedance defined at least in part by an exterior first diameter of an inner conductor and an interior second diameter of an outer conductor, said connector comprising:

a male portion including an electrically conductive center choke conductor defining a proximal end and a distal end, and an electrically conductive outer choke conductor also defining a proximal end and a distal end, said proximal end of said center choke conductor being coupled to said inner conductor of said coaxial transmission line, and said proximal end of said outer choke conductor being coupled to said outer conductor of said coaxial transmission line, said center choke conductor of said male portion of said coaxial choke connector having a first length, a circular cross-section centered on a longitudinal axis, and a third diameter less than said first diameter, and said outer choke conductor having an inner fourth diameter which defines a circular cross-section centered on said axis, said fourth inner diameter being larger than said second diameter, said center choke conductor having a layer of solid dielectric on the outer surface thereof, so that said center choke conductor with said layer of solid dielectric thereon has a fifth diameter smaller than said first diameter;

a female portion including an electrically conductive center choke conductor and an electrically conductive outer choke conductor, said inner choke conductor of said female portion of said coaxial choke connector defining a closed-end axial bore with respect to said longitudinal axis, said axial bore having a sixth diameter larger than said fifth diameter and a second length, said center choke conductor of said female portion having an outer diameter equal to said first diameter, said outer choke conductor of said female portion having an inner diameter equal to said second diameter, and an outer diameter coated with a solid dielectric material, so that the overall outer diameter of said outer choke conductor of said female portion together with said solid dielectric material has a seventh diameter, smaller than said fourth diameter.

10. A coaxial choke connector for use with a first transmission line having a characteristic impedance which, if the first transmission line were a coaxial transmission line, would be defined at least in part by an exterior first diameter of an inner conductor and an interior second diameter of an outer conductor, said coaxial choke connector comprising:

a male portion including an electrically conductive center choke conductor defining a proximal end and a distal end, and an electrically conductive outer choke conductor also defining a proximal end and a distal end, said proximal end of said center choke conductor being coupled to a first conductor of said first transmission line, and said proximal end of said outer choke conductor being coupled to a second conductor of said first transmission line, said center choke conductor of said male portion of said coaxial choke connector having a first length, an ovoid cross-section centered on a longitudinal axis, and a third transverse dimension less than said first diameter, and said outer choke conductor having an inner fourth dimension which defines an ovoid cross-section centered on said axis, said fourth inner dimension being larger than said second diameter;

a female portion including an electrically conductive center choke conductor and an electrically conductive outer choke conductor, said inner choke conductor of said female portion of said coaxial choke connector defining a closed-end axial aperture with respect to said longitudinal axis, said axial aperture having a transverse sixth dimension larger than a transverse fifth dimension and a second length, said center choke conductor of said female portion having a transverse outer dimension equal to said first diameter, said outer choke conductor of said female portion having a transverse inner dimension equal to said second diameter;

a first layer of solid dielectric material lying on one of (a) the outer surface of said center choke conductor of said male portion so that said center choke conductor with said layer of solid dielectric thereon has said transverse fifth dimension smaller than said first diameter and (b) the inner surface of said closed-end axial aperture of said center choke conductor of said female portion; and a second layer of solid dielectric material lying on one of (a) an outer surface of said outer choke conductor of said female portion, so that the overall outer dimension of said outer choke conductor of said female portion together with said solid dielectric material has a seventh dimension, smaller than said fourth dimension and (b) an inner surface of said outer choke conductor of said male portion.

11. A coaxial choke connector for use with a first transmission line having a characteristic impedance which, if the first transmission line were a coaxial transmission line, would be defined at least in part by an exterior first diameter of an inner conductor and an interior second diameter of an outer conductor, said coaxial choke connector comprising:

a male portion including an electrically conductive center choke conductor defining a proximal end and a distal end, and an electrically conductive outer choke conductor also defining a proximal end and a distal end, said proximal end of said center choke conductor being coupled to a first conductor of said first transmission line, and said proximal end of said outer choke conductor being coupled to a second conductor of said first transmission line, said center choke conductor of said male portion of said coaxial choke connector having a first length, a rectangular cross-section centered on a longitudinal axis, and a third dimension less than said first diameter, and said outer choke conductor having an inner fourth dimension which defines a rectangular cross-section centered on said axis, said fourth inner dimension being larger than said second diameter;

a female portion including an electrically conductive center choke conductor and an electrically conductive outer choke conductor, said inner choke conductor of said female portion of said coaxial choke connector defining a closed-end axial aperture with respect to said longitudinal axis, said axial aperture having a sixth dimension larger than a fifth dimension and a second length, said center choke conductor of said female portion having an outer dimension equal to said first diameter, said outer choke conductor of said female portion having an inner dimension equal to said second diameter;

a first layer of solid dielectric material lying on one of (a) the outer surface of said center choke conductor of said male portion so that said center choke conductor with said layer of solid dielectric thereon has said fifth dimension smaller than said first diameter and (b) the inner surface of said closed-end axial aperture of said center choke conductor of said female portion; and a second layer of solid dielectric material lying on one of (a) an outer surface of said outer choke conductor of said female portion, so that the overall outer dimension of said outer choke conductor of said female portion together with said solid dielectric material has a seventh dimension, smaller than said fourth dimension and (b) an inner surface of said outer choke conductor of said male portion.

* * * * *